US010920579B2

(12) United States Patent
Beaman, Jr. et al.

(10) Patent No.: US 10,920,579 B2
(45) Date of Patent: Feb. 16, 2021

(54) METHOD AND APPARATUS FOR EARLY DETECTION OF KICKS

(71) Applicants: Board of Regents, The University of Texas System, Austin, TX (US); BP Corporation North America Inc., Houston, TX (US)

(72) Inventors: Joseph J. Beaman, Jr., Austin, TX (US); Scott Fish, Austin, TX (US); David A. Foti, Waco, TX (US); Warren J. Winters, Cypress, TX (US)

(73) Assignees: Board of Regents, The University of Texas System, Austin, TX (US); BP Corporation North America Inc., Houston, TX (US)

( * ) Notice: Subject to any disclaimer, the term of this patent is extended or adjusted under 35 U.S.C. 154(b) by 473 days.

(21) Appl. No.: 15/045,362

(22) Filed: Feb. 17, 2016

(65) Prior Publication Data

US 2016/0237810 A1 Aug. 18, 2016

Related U.S. Application Data

(60) Provisional application No. 62/117,061, filed on Feb. 17, 2015.

(51) Int. Cl.

| | |
|---|---|
| ***E21B 47/10*** | (2012.01) |
| ***E21B 41/00*** | (2006.01) |
| ***E21B 47/00*** | (2012.01) |
| ***E21B 21/08*** | (2006.01) |

(52) U.S. Cl.
CPC ..... *E21B 47/10* (2013.01); *E21B 21/08* (2013.01); *E21B 41/00* (2013.01); *E21B 47/00* (2013.01)

(58) Field of Classification Search
CPC ..... E21B 47/10; E21B 47/00; E21B 41/00; E21B 21/08
See application file for complete search history.

(56) References Cited

U.S. PATENT DOCUMENTS

2002/0134587 A1* 9/2002 Rester ..... E21B 47/107 175/48
2013/0311097 A1* 11/2013 Livesay ..... E21B 44/00 702/11
2016/0201393 A1* 7/2016 Lannen ..... E21B 44/00 175/40

* cited by examiner

*Primary Examiner* — Vongsavanh Sengdara
(74) *Attorney, Agent, or Firm* — Nolte Lackenbach Siegel

(57) ABSTRACT

A well monitoring system particularly useful in detecting kicks in the well includes a well, a well system, and a computing apparatus. The well defines a wellbore and the well system includes at least one sensor measuring at least one well condition. The computing apparatus hosts a well monitoring software component that performs a method to detect a kick in a well. The method includes: storing a set of real-time data from a measurement of a well condition by the sensor, the measurements being correlative to an unplanned fluid influx into the well; modeling the operation of the well with a physics-based, state space model of the well system to obtain an estimate of the well condition; and applying the real-time data set and the estimate to a probabilistic estimator to yield a probability of an occurrence of a kick and a confidence measure for the probability.

24 Claims, 4 Drawing Sheets

*FIG. 1*

METHOD AND APPARATUS FOR EARLY DETECTION OF KICKS

CROSS-REFERENCE TO RELATED APPLICATIONS

This application claims the priority of U.S. Provisional Application Ser. No. 62/117,061, filed Feb. 17, 2015, and hereby incorporates that application by reference for all purposes as if set forth verbatim herein.

STATEMENT REGARDING FEDERALLY SPONSORED RESEARCH OR DEVELOPMENT

Not applicable.

BACKGROUND

This section of this document introduces various information that may be related to or provide context for some aspects of the technique described herein and/or claimed below. It provides background information to facilitate a better understanding of that which is disclosed herein. This is therefore a discussion of "related" art. That such art is related in no way implies that it is also "prior" art. The discussion in this section is to be read in this light, and not as admissions of prior art.

The efforts of the oil and gas industry to discover and bring into production new or additional hydrocarbon deposits has led to ever more sophisticated and demanding technical environments. This sophistication and demand is reflected in the costs of the endeavor. One part of this evolution in the industry responsive to these concerns is improved techniques for monitoring and managing phenomena such as "kicks". Kicks are unplanned subsurface fluid or gas flow influxes from the geological reservoir into the wellbore during oil and gas drilling, tripping, and completion or intervention operations. Drilling mud, completion fluids, and drilling cement serve as barriers against pressurized hydrocarbons in the reservoir and keep them sealed in the reservoir until production commences. In the event that wellbore fluid pressures become less than that of an exposed subsurface formation, a kick may occur. Drilling operations and unanticipated high pressure gas pockets in porous rock formations can lead to pressure imbalances between wellbore fluids and reservoir fluids, causing gas influx into the wellbore or loss of drilling mud into the reservoir.

One issue in kick detection is that the conditions indicating that a kick has occurred are typically not readily detectable by the human eye. A fair portion of this fact is that many of the conditions used to detect or predict a kick are downhole, and so are not readily discernible directly to the human eye. Some factors may be deduced at the surface but the delay caused by the change to in conditions propagating to the surface works against the need for a quick detection. Accordingly, the industry typically instruments a string downhole as well as at the surface to monitor condition which might indicate that a kick has occurred.

However, even with automated monitoring systems, many techniques for detecting and managing kicks suffer from a number of drawbacks. It is not uncommon for them to rely on lagging rather than leading indicators, which can delay an otherwise timely response. They are also subject unpredictable human error. For example, many of the measured parameters may be correlated to the unplanned influx of formation fluids into the wellbore without being indicative, or the operator may miss the significance of a piece or stream of information.

The presently disclosed technique is directed to resolving, or at least reducing, one or all of the problems mentioned above. As set forth above, several techniques for monitoring well conditions and detecting kicks are known to the art and are competent for their intended purposes. The art, however, is always receptive to improvements or alternative means, methods, and configurations. Therefore the art will consequently well receive the technique described herein.

SUMMARY

The presently disclosed technique presents to the art a well monitoring system particularly useful in detecting kicks in the well. The well monitoring system comprises a well, a well system, and a computing apparatus. The well defines a wellbore and the well system includes at least one sensor measuring at least one well condition. The computing apparatus includes a processor, storage, a bus system over which the processor communicates with the storage, a data structure residing in the storage, and a well monitoring software component residing in the storage. The data structure stores real-time data acquired by the sensor.

The well monitoring software component, when executed by the processor over the bus system, performs a method to detect a kick in a well. The method comprises: storing a set of real-time data from a measurement of a well condition by the sensor, the measurements being correlative to an unplanned fluid influx into the well; modeling the operation of the well with a physics-based, state space model of a well system of the well to obtain an estimate of the well condition; accessing the stored real-time data set; and applying the accessed real-time data set and the estimate to a probabilistic estimator to yield a probability of an occurrence of a kick and a confidence measure for the probability.

Other aspects of the presently disclosed technique include a computer-implemented method to detect a kick, a non-transitory program storage medium encoded with instructions that, when executed, perform such a computer-implemented method, and a computing apparatus programmed to perform such a method.

The above presents a simplified summary of the invention in order to provide a basic understanding of some aspects of the subject matter disclosed herein and claimed below. This summary is not an exhaustive overview of that which is claimed. It is not intended to identify key or critical elements of the claimed subject matter or to delineate its scope. The sole purpose of this summary is to present some concepts in a simplified form as a prelude to the more detailed description that is discussed later.

BRIEF DESCRIPTION OF THE DRAWINGS

The claimed subject matter may be understood by reference to the following description taken in conjunction with the accompanying drawings, in which like reference numerals identify like elements, and in which:

Figure 1:
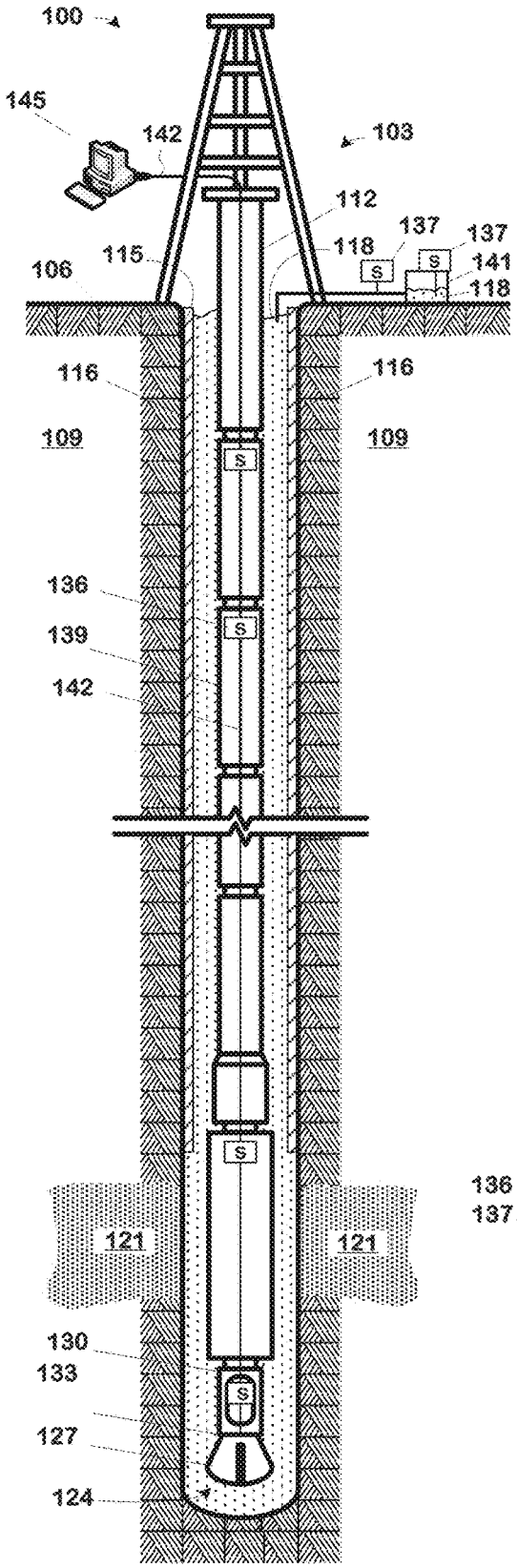
FIG. 1 depicts a drilling operation in which one particular embodiment of the presently disclosed technique is practiced in a partially sectioned, plan view.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The technique disclosed herein and claimed below employs a cyber-physical approach to the detection, monitoring, and managing of kick in wells. For present purposes, a "cyber-physical" technique is one in which a model of the well system for the well is coupled to the well system in operation. The model and well system are coupled in that the model incorporates system knowledge and physical knowledge of the well system developed during the well system's design and implementation. The model then resides and operates in a virtual environment to model the well system's operation in real time while the well system is operating based on information acquired by interacting with the well system through the coupling. In this sense, the model "mirrors" the operation of the well system and can continuously track and provide information regarding the well system's operation that is not always amenable to direct observation. This information can then be analyzed to determine whether a kick is actually occurring or even is imminent before it happens.

Unlike conventional practice, the cyber-physical approach combines multiple measurements by linking the measurements of the operation with the physics of the operation. This provides for natural scaling of the measurements relative to each to other for making predictions of output variables. It also provides for natural filtering or smoothing of the estimate. Conventional practice, on the other hand, relies on ad hoc smoothing or averaging of the measured data. The presently disclosed technique furthermore does not just trigger on a pattern in the data but provides a quantifiable estimate of a kick with quantifiable uncertainty.

This technique uses multiple real-time measurements of conditions in the well environment that can be linked, or correlated, to kick. In a drilling context, commonly available variables include mud pit volume, return flow, input flow, standpipe pressure, drilled depth, hook load, gas content, and others. These measurements are combined with physics-based, state space models of the operation. It is applicable in a wide variety of wells including both on-shore and off-shore in which there are a variety of types and accuracies of measurements and physical configurations.

One principle of the technique is that combining multiple measurements of even very noisy and uncertain measurements reduces the uncertainty in estimated values provided by the models. In some embodiments, these measurements are then combined with estimates made by a physics-based state space model to produce even more accurate estimated values representing a probability. For example, a typical output estimated value of interest in early kick detection is amount (mass or moles) of hydrocarbon influx. This combination uses measurements that are numerically quantified by the states of the model. In order to combine measurements and model estimates this approach also quantifies the uncertainties in the measurements and the model. Model uncertainty includes uncertainty in both model inputs and in model parameters.

Once this has been done a real-time probabilistic estimator is then used to estimate the states of the model, which give probabilistic estimates—or, a probability—of outputs such as hydrocarbon influx. The estimator gives not only a most likely value but also the uncertainty of the value. These procedures allow estimation of values that cannot be easily measured.

The physics of the model allow construction of a relationship between measured quantities and kick. In one embodiment, a simple incompressible hydraulic model allows us to link the pump pressure to the bottom hole pressure and with a model of the formation permeability. This allows a prediction of influx rate.

Higher fidelity models, which predict variables with more accuracy, can also be used. There is a trade-off between higher fidelity and simulation time. Some embodiments may seek prediction in real-time. If the model runs slower than real-time there are at least two remedies. One is to develop a lower order model that captures the important physics of the high fidelity model. The second is to use modern computer architecture and hardware that can run parallel processes. These systems are becoming available at very low cost. A graphics processing unit is an example of some this new computer hardware.

The presently disclosed technique will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention.

Turning now to FIG. 1, a drilling operation 100 includes a hydrocarbon well 103 drilled through the earth's surface 106 and into and through a subterranean formation 109 surrounding the hydrocarbon well 103. The hydrocarbon well 103 includes a string 112 shown run into the wellbore 115. The wellbore 115 is also filled with drilling fluids 118 in a manner known to the art for purposes well known to the art. The drilling fluids 118 may be any kind of drilling fluid known to the art and suitable for the purpose for which it is introduced. For example, the drilling fluids 118 may be a drilling "mud" introduced to maintain the hydrostatic pressure of the well 103 at a desired level. The wellbore 115 passes through a portion of the formation 109 containing deposits of formation fluids 121, such as water or brine, or a hydrocarbon such as natural gas or petroleum. The identity of the formation fluids 121 is not material to the practice of the technique disclosed and claimed herein although it may be significant in a given embodiment.

Those skilled in the art having the benefit of this disclosure will appreciate that the illustration in FIG. 1 is highly idealized. For example, the subterranean formation 109 is illustrated in a manner from which one might infer it is of a homogeneous composition. Those in the art will understand that this is unlikely to be the case and that the subterranean formation 109 will contain many strata (not shown) of varying geophysical characteristics. Similarly, there may be many deposits of formation fluids 121 in the subterranean formation 109 or, in some circumstances, none. These and other such variations which have been suppressed for the sake of clarity will be readily recognized by those skilled in the art.

The wellbore 115 is "cased", as is evident from the casing 116. Most wells will be cased as shown. However, the presently disclosed technique is not limited to cased wells. It may also be applied to what are known as "open holes", or those wells whose wellbores remain uncased or from which previously installed casing has been removed. It may also be applied to cased wells that are open at the bottom.

The drill string 112 includes, for example, a bottom hole assembly 124 comprised of a bit 127, data and crossover sub 130, and sensor apparatus 133. The drill string 112 also includes other conventional string components that are not indicated such as tools, jars, stabilizers, drill collars, and drill pipe. The constitution, assembly, and deployment of the drill string 112 may accord with conventional practice using principles and techniques well known to those in the art.

Those in the art might infer from the presence of the bottom hole assembly 124 that the operation depicted in FIG. 1 is a drilling operation. However, the presently disclosed technique is not necessarily limited to use in drilling operations. The presently disclosed technique may be used in practically any phase of well operations in which kick is of interest.

It is well known to instrument the drill string 112 with a variety of sensors 136 (only one indicated) to monitor conditions throughout the wellbore 115. For example, the data and crossover sub 130 may house an accelerometer (not otherwise shown) useful for gathering real-time data from the bottom of the wellbore 115. For example, the accelerometer can give a quantitative measure of bit vibration. Many types of data sources may and typically will be included. Exemplary measurements that may be of interest include hole temperature; the pressure, salinity and pH of the drilling mud; the magnetic declination and horizontal declination of the bottom-hole assembly; seismic look-ahead information about the surrounding formation; electrical resistivity of the formation; pore pressure of the formation; gamma ray characterization of the formation, and so forth.

Any given embodiment will typically be more interested in some quantities than in others. In particular, as is described further below, the inputs to the models should be correlated in some way to kick. Thus, quantities such as mud pit volume, return flow, input flow, standpipe pressure, drilled depth, hook load, gas content, etc. will be of particular interest.

To this end, a variety of instrumented tools 139 (only one indicated) for gathering information regarding downhole drilling conditions will be included in the drill string 112. However, not all sensors 136 will necessarily be disposed on or in an instrumented tool 139. The sensors 136 may be disposed anywhere throughout the drill string 112 in any manner suitable to those skilled in the art that is known to the art.

Note that the embodiments illustrated herein are intended for use with quantities that are already sensed and whose measurements are already available through well monitoring software. The technique is therefore suitable for retrofit onto existing wells. However, there is no need to limit other embodiments to those quantities that are already sensed and whose measurements are available. Some embodiments may contemplate the use of quantities not typically sensed such that additional sensors may be added to the string over and above those that are conventionally used.

Information sensed by the sensors 136 is communicated back to the surface 106 where it is collected. In the illustrated embodiment, the information is communicated electronically over a line 142 to a computing apparatus 145. The sensed information is converted into digital data at the sensor 136 and electronically transmitted over the line 142. In some embodiments, the data transmission is interleaved on the line 142. Some embodiments may employ more than one line 142 to avoid or alleviate operational constraints imposed by using a single line 142. Some embodiments may even transmit some or all of the information wirelessly. There are still other techniques known to the art by which the sensed information may be communicated to the surface. Any such technique known to the art suitable for the purpose may be employed in alternative embodiments.

It is also known to instrument surface operations. For example, in FIG. 1 there is conceptually shown a mud pit 141 from which the mud 118 is pumped into the wellbore 115 and to which mud 118 is returned from the wellbore 115. Sensors 137 measure various aspects of the well 103's operation with respect to the mud pit 141 such as mud volume in the mud pit 141 and the rate of flow out of the mud pit 141. The measurements are then also communicated to the computing apparatus 145 over a line not shown in FIG. 1. Those in the art will appreciate that many aspects of surface operations are monitored in this fashion and that the mud pit operations are merely illustrative of surface operations in general.

Figure 2:
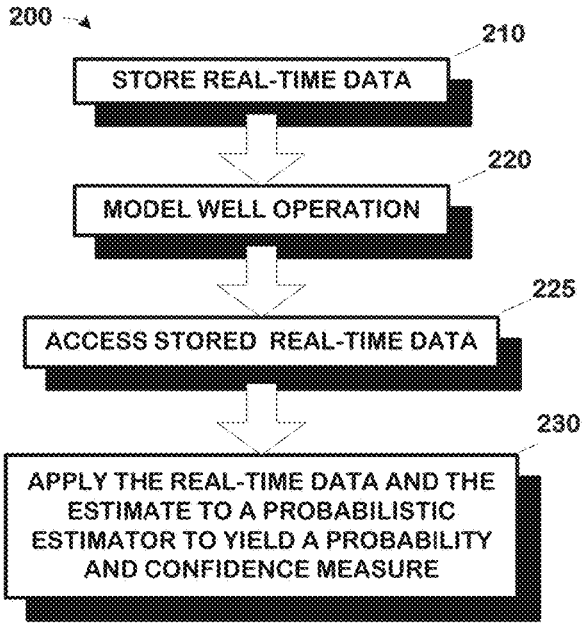
FIG. 2 presents one particular embodiment of a method practiced in accordance with the technique disclosed herein.

FIG. 2 illustrates a method 200 in accordance with one aspect of the presently disclosed technique. The method 200 is, in this particular embodiment, performed at least in part by the computing apparatus 145. A brief description of those portions of the computing apparatus 145 pertinent to that performance shall therefore now be discussed before returning to FIG. 2.

Figure 3:
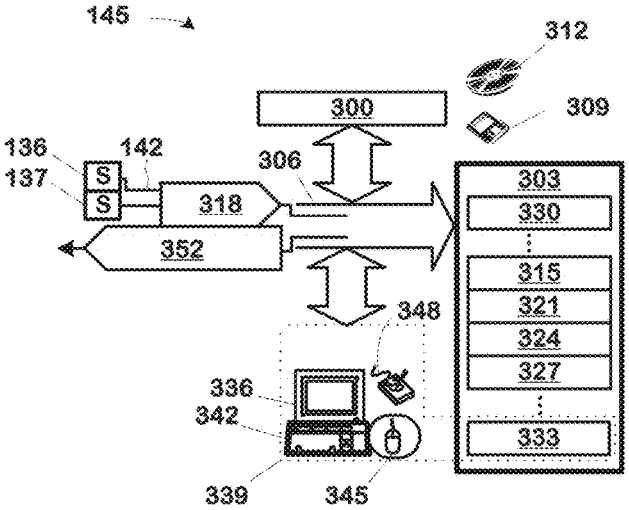
FIG. 3 conceptually illustrates selected portions of the hardware and software architecture of a computing apparatus such as may be employed in some aspects of the present invention.

FIG. 3 shows selected portions of the hardware and software architecture of one particular embodiment of the computing apparatus 145. The computing apparatus 145 includes in this embodiment a processor 300 communicating with storage 303 over a bus system 306. The storage 303 may include a hard disk and/or random access memory ("RAM") and/or removable storage such as a floppy magnetic disk 309 and an optical disk 312.

The processor 300 may be any suitable processor known to the art. Those in the art will appreciate that some types of processors will be preferred in various embodiments depending on familiar implementation specific details. For example, some processors are more powerful and process faster so that they may be more preferred where large amounts of data are to be processed in a short period of time. On the other hand, some processors consume more power and available power may be severely limited in some embodiments. Low power consumption processors may therefore be preferred in those embodiments.

These kinds of factors are, commonly encountered in the design process and will be highly implementation specific. Because of their ubiquity in the art, such factors will be easily reconciled by those skilled in the art having the benefit of this disclosure. Those in the art having the benefit of this disclosure will therefore appreciate that the processor 300 may be a micro-controller, a controller, a microprocessor, a processor set, or an appropriately programmed application specific integrated circuit ("ASIC") or field programmable gate array ("FPGA"). Some embodiments may even use some combination of these processor types.

As with the processor 300, implementation specific design constraints may influence the design of the storage 303 in any particular embodiment. For example, it is well known that certain types of types of memory (e.g., cache) have much faster access times than other types (e.g., disk memory). Some types of memory will also consume more power than others. Some embodiments may wish to only temporarily buffer acquired data whereas others may wish to store it for a more prolonged period. As with the processor 300, these kinds of factors are commonplace in the design process and those skilled in the art having the benefit of this disclosure will be able to readily balance them in light of their implementation specific design constraints.

The storage 303 is encoded with a data structure 315 in which the data 318 received from the one or more sensors 136 over the line 142 may be buffered or otherwise stored. As is apparent from the discussion above, the data 318 comprises information regarding the drilling conditions in the wellbore 115, the drilling fluids 118, the wellbore 115, and the surrounding formation 109. The data 318 therefore represents tangible, real world object—namely, the wellbore 115, drilling fluids 118, and the formation 109. The data structure 315 may be any suitable data structure known to the art, such as a buffer, a string, a linked list, a database, etc. The data 318 may be buffered or it may be stored more long term—even archived—depending on the embodiment. The data structure 315 may even be a composite of constituent data structures (not shown) if, for example, it is desired to have a separate data structure for each set of data generated by different sensors 136. The disclosed technique admits wide variation in the implementation of the data structure 315.

A well monitoring software component 321 that performs the software-implemented method described below is also encoded on the storage 303. The well monitoring software component 321 may be coded in any suitable manner known to the art. The well monitoring software component 321 is, in this particular embodiment, an application. Note, however, that there is no requirement that this functionality be implemented in an application. For example, the well monitoring software component 321 may be implemented in some other kind of software component, such as a daemon or utility. The functionality of the well monitoring software component 321 also need not be contained in a single software component and may be separated into two or more components. The functionality may be aggregated into a single component or distributed across more than two components.

The storage 303 is also encoded with one or more physics-based state space model(s) 324 of the well system and a probabilistic estimator 327. The model(s) 324 and probabilistic estimator 327 are used by the well monitoring software component 321 as described below to implement the software implemented aspects of the presently disclosed technique. The model(s) 324 and the probabilistic estimator 327 are also described in more detail below. Just as the well monitoring software component 321 may be implemented in wide variation across embodiments, so may the model(s) 324 and the probabilistic estimator 327. For example, rather than being stand-alone components called by the well monitoring software component 321, either one or both of the model(s) 324 or the probabilistic estimator 327 may be incorporated into the well monitoring software component 321. Or, they may be separate from the well monitoring software component 321 but combined with each other into another component.

In particular, the model(s) 324 model the well system of the well 100 that are pertinent to a kick. For example, in the detection of kick, the pertinent parts of the well system that should be modeled include the hydraulics, the mechanics of the system, and the formation. They hydraulics would include information such as the physical characteristics (e.g., weight, temperature, pH, gas content), the volume, and the rate of circulation of the drilling fluids as well as return flow and input flow. The mechanics of the system includes such things as the mud pit volume, the drilled depth of the wellbore, the cased diameter of the wellbore, the rate of penetration, standpipe pressure, the hook load, and other information pertaining to the physical characteristics of the wellbore. The formation would include geophysical characteristics such as those listed in Table 3 below. The various part of the well system may be separately modeled and then interfaced or all integrated into a single model. Thus, the models(s) 324 may be a single model or a plurality of models.

The storage 303 is also encoded with an operating system 330 and user interface software 333. The user interface software 333, in conjunction with a display 336, implements a user interface 339. The user interface 339 may include peripheral I/O devices such as a keypad or keyboard 342, a mouse 345, or a joystick 348. The processor 300 runs under the control of the operating system 330, which may be practically any operating system known to the art. The well monitoring software component 321 is invoked by the operating system 330 upon power up, reset, or both, depending on the implementation of the operating system 330. The application 465, when invoked, performs the method of the present invention. The user may also invoke the monitoring software component 321 in conventional fashion through the user interface 339 in some embodiments.

One aspect of the presently disclosed technique that separates it from many computing applications is the computationally intensive nature of the tasks to which it is assigned. The software processes voluminous real-time data through a model of the well system and quick resolution and reporting are typical objectives. It is unlikely that a general purpose computing apparatus will meet these performance considerations. The process 300 should be implemented as a processor set that will include some degree of parallel processing. The storage 303 should be designed for rapid read/write operations, which favors RAM and cache of removable storage. The model(s) 327 should be designed or selected with a suitable balance of resolution and speed. These and other design considerations mitigate for a computing environment that is much more computationally robust than in a general purpose computing environment.

As is evident from the discussion above, some portions of the detailed descriptions herein are presented in terms of a software implemented process involving symbolic representations of operations on data bits within a memory in a computing system or a computing device. These descriptions and representations are the means used by those in the art to most effectively convey the substance of their work to others skilled in the art. The process and operation require physical manipulations of physical quantities that will physically transform the particular machine or system on which the manipulations are performed or on which the results are stored. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated or otherwise as may be apparent, throughout the present disclosure, these descriptions refer to the action and processes of an electronic device, that manipulates and transforms data represented as physical (electronic, magnetic, or optical) quantities within some electronic device's storage into other data similarly represented as physical quantities within the storage, or in transmission or display devices. Exemplary of the terms denoting such a description are, without limitation, the terms "processing," "computing," "calculating," "determining," "displaying," and the like.

Furthermore, the execution of the software's functionality transforms the computing apparatus on which it is performed. For example, acquisition of data will physically alter the content of the storage, as will subsequent processing of that data. The physical alteration is a "physical transformation" in that it changes the physical state of the storage for the computing apparatus.

Note also that the software implemented aspects of the invention are typically encoded on some form of non-transitory program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The invention is not limited by these aspects of any given implementation.

Another thing that will typically separate the computing aspects of the technique from general purpose computing is the environment of the well system. The computing apparatus 145 nominally appears as a work station in FIG. 1. Those in the art having the benefit of this disclosure will appreciate that many, if not most, rigs are equipped with computers of some kind. These computers are hardened against vibration, dust, and other environmental conditions encountered in a drilling environment but not in more sedate office and residential environments. Some of these computers may be rack mounted rather than a stand-alone workstation. The computing apparatus 145 may be, in some embodiments, a computer already on a rig retrofitted to implement the technique disclosed herein. Alternatively, rigs may be equipped with new computers not only programmed to implement the present technique but also finished out in accordance with practices well known to the art to adapt them to the drilling environment.

There also is no theoretical or operational requirement that the computing apparatus 145 be implemented in a single, unitary, integrated package. For example, some embodiments might choose to store the data 318 locally while hosting the well monitoring software component 321 offsite at another location. In these embodiments, the data 318 can be accessed by the well monitoring software component 321 for analysis remote from the location at which it is collected. Information output by the well monitoring software component 321 can then be utilized at that remote location, or locally at the location where it is collected, or at yet a third location.

Referring now to both FIG. 2 and FIG. 3, the method 200 is performed by the well monitoring software component 321 when invoked by the processor 300 over the bus system 306. The method 200 assumes that well monitoring through, for example, the sensors 136 and 137 is ongoing in a manner known to the art and that the sensed measurements are being stored in the data structure 315 as data ("DATA"). The data is therefore real-time data. Note that some embodiments may also employ near real-time or even archived data in addition to real-time data.

The method 200 begins, in this particular embodiment, with the well monitoring software component 321 storing (at 210) a set of real-time data from a measurement of a well condition acquired during the operation of the well, the measurements being correlative to an unplanned fluid influx into the well 103. The measured well condition may be a downhole condition or a surface condition. Typically, a plurality of measured conditions is used and that plurality will include both downhole and surface conditions. The conditions themselves, as well as their measurements, may be independent of one another or they may be related. Again, most embodiments will typically include both independent and related measurements.

The well monitoring software component 321 also models (at 220) the operation of the well 103 with a physics-based, state space model 324 of well system of the well 103 to obtain an estimate of the well condition, the model being cyber-physically coupled to the well system. It also accesses (at 225) the stored real-time data set. The accessing (at 225) and the modeling (at 220) may be performed sequentially or simultaneously and, if sequentially, the order in which they are performed is not material. The method 200 then applies (at 230) the accessed real-time data set and the estimate to a probabilistic estimator to yield a probability of an occurrence of a kick and a confidence measure for the probability.

Once the probability and its confidence measure are obtained (at 230), it may be used in a variety of ways. In one embodiment, it is communicated to a drilling engineer or some other operator who then decides whether corrective action is warranted and, if so, what that action might be. Or, the process may be automated so that when the probability breaches a specified threshold within a specified confidence measure, certain corrective actions are automatically taken. What these corrective actions might be will be implementation specific and will depend on the circumstances of the kick within the context of the well. The probability and its confidence measure may also be archived for review at a later date.

Figure 4:
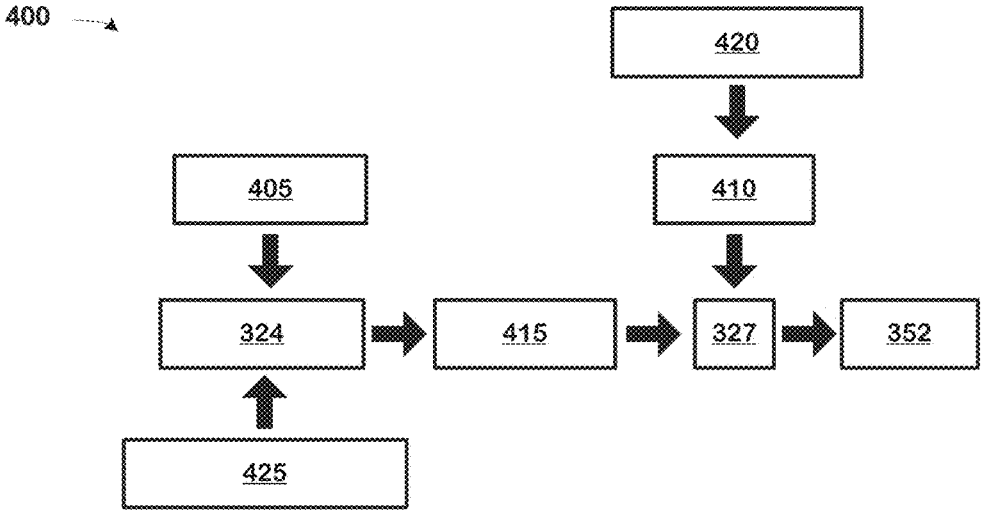
FIG. 4 graphically illustrates the performance of the method of the disclosed technique in one particular embodiment.

Turning now to FIG. 3 and FIG. 4, the process flow 400 encompasses the computer-implemented method 200 of FIG. 2. In operation, the sensors 136 and 137 sense their respective quantities and communicate those values as described above. The well system model 324 is previously constructed using a priori knowledge 405 of the well, such as the well geometry, the formation structure, etc. and is a physics-based, state space model of the well system. (Examples of two suitable models are given below.) Inputs to the well system model 324 can be defined as prescribed boundary conditions of the model. For example, these can be pressures, flow rates, temperatures, geometry, and mole fractions. These are generally values that one can set in the operation of the well and can be static (i.e., constant) or dynamic (time-varying).

Both the well system model 324 and the real-time information 410 will have uncertainties associated with them. More particularly, the well system model 324 includes model parameter uncertainties 425 and the real-time information 410 includes measurement uncertainties 420. Model parameter uncertainties 425 will typically arise from variability in mud and formation properties. Measurement uncertainties 420 will typically arise from margins for error in the sensors used to take the measurements.

The data 315 comprises measurements of conditions in the wellbore 115 of the well 103 and at the surface as described above. The real-time information 410 is selected from the data 315 because it is correlative to a kick. Thus, the identity of the real-time information 410 will depend not only on what data 315 is available, but on its relationship to the presence or absence of kick. The real-time information 410 is "real-time" in the sense that it is input to the well system model as soon as it is available. Different sensors will sample at different rates, and thus some of the real-time information 410 will be fresher than will some other information. But the real-time information 410 constitutes the freshest information available at the time given the rates at which the data 315 is sampled.

The physics-based, state space well system model 324 generates an estimate of a modeled condition correlative to a kick. A kick can generally be represented by a downhole or surface condition that is quantifiable but not amenable to direct measurement. For example, a kick may be indicated by an influx of formation fluids that cannot be directly measured, but that will affect the values of quantities that can be measured, such as those discussed below. The well system model 324 estimates a value for just such a quantifiable, not directly measured, condition.

In the illustrated embodiments, the real-time simulation 415 also yields an uncertainty measure, which is a measure in the confidence of the estimated value. The uncertainty measure is a function of the model parameter uncertainties 425. This information will be known from the implementation of both the well 103 and the well system model 324 and the formulation of the model. For example, certain assumptions may underlie the design of the model and introduce uncertainties into the results. One such set of assumptions is discussed further below in connection with a particular model.

The estimate from the real-time simulation 415 obtained from the well system model 324 and its model parameter uncertainties 425 are then applied along with the real-time information 410 and its measurement uncertainty 420 to a probabilistic estimator 327. The probabilistic estimator 327 then yields a probability of an occurrence of a kick and a confidence measure for the probability 352. In the illustrated embodiments, the uncertainties are represented by Gaussian distributions but other types of distributions may be used as well. Furthermore, the probabilistic estimator 327 is a Bayesian estimator although alternative embodiments may employ different probability theories.

The probability and the confidence measure 352 are then communicated to a drilling engineer in this particular embodiment. The manner in which the communication is performed and to whom the communications is made will be implementation specific. For example, the probability and the confidence measure 352 may be communicated by rendering it into a graphic display in human perceptible form for viewing by an operator of the well. Alternatively, the probability and the confidence measure 352 may be communicated to an alarm that automatically sounds if the value of the probability and the confidence measure 352 exceeds some predetermined threshold.

A more detailed disclosure of one particular implementation of the techniques described herein shall now be provided to further an understanding of the subject matter claimed below. The technique detects a "kick", which as described above is an unwanted penetration of fluids from the formation into the wellborn. The embodiment now being described is concerned with kicks arising from the influx of gas from the formation. When the gas enters the wellbore, it can rise up the annulus either as free gas or dissolved gas in drilling mud. As it encounters lower pressure regions at the top of the annulus, it expands, and dissolved gas comes out of solution. In detecting kicks early, well control personnel can isolate the influx and circulate it out while re-balancing the well for continued operation In the context of FIG. 1, a kick may occur when the formation fluids 121 penetrate into the wellbore 115. Such a condition may be caused in a number of ways. For example, the volume or density of the drilling fluids 118 might drop so that the hydrostatic pressure exerted by the drilling fluids 118 is less than the pressure to which the formation fluids 121 are subject. Or, motion of the drill string 112 in the wellbore 115 might cause the hydrostatic pressure to effectively decrease, thereby creating a pressure differential leading to a kick. Those in the art may appreciate other ways in which such a pressure differential may be created and, thus, other ways in which a kick may be initiated.

There are known downhole conditions that may be considered "kick indicators". For present purposes, indicators can be either primary or secondary. Primary indicators are those changes that are attributable to kicks alone, while secondary indicators may be caused by other drilling anomalies or well maneuvers. Primary kick indicators may include an increase in outflow rate, mud pit gain, incorrect fluid fill while tripping, positive flow while pumps are off, etc. Secondary kick indicators may include a decrease in stand pipe pressure and pump pressure, an increase in gas content in outflow mud, increase in rate of penetration, etc. Still other indicators may be known to those in the art having the benefit of this disclosure.

These quantities are considered "indicators" because they are correlated to a kick. For example, an increase in outflow rate may be an indicator because sustained deviation between known inflow rate and measured outflow rate could be caused by a kick. For a mud pit gain, the closed mud loop serves to circulate mud around the well with the mud pit serving as a storage tank. An increase in the volume of fluid in the mud pit could be an indication of influx from the reservoir. On the other hand, for incorrect fluid fill while tripping, if pit volume does not reduce by an amount equal to the volume of steel being removed while tripping out, a kick may be occurring.

Similar correlations can be made for secondary kick considerations. A decrease in stand pipe pressure and pump pressure can be caused by gas influx into the annulus, which causes a decrease in the density of annulus fluid, and consequently a decrease in the hydrostatic pressure that creates a pressure deferential between drill pipe and annulus. This forces fluid from drill pipe to annulus, effectively reducing standpipe pressure. Note that the pump pressure should increase initially through exposure to the influx fluid, then decrease with continuous influx. For an increase in gas content in outflow mud, the percentage of gas in mud increases with kick, although this may also mean that a gas-bearing formation has been drilled through. An increase in rate of penetration (drilling break) occurs when more porous rock formations are encountered, which comes with increased risk of gas kick.

The well system model 324 in this embodiment incorporates a model of a kick in the context of the well system 103. Inherent in a model-based approach is the assumption that all computational parameters and variables, whether surface or downhole, can be transferred in real-time to calculation servers and that results from the computer models are immediately available for application. A first, detailed model approach for the well flow system and formation in a discretized distributed flow model will now be discussed. An alternative will be discussed afterward.

The first model is expressed mathematically in a series of equations using a number of variables. As those in the art will appreciate, mathematical expressions are simply stand-ins for verbal descriptions. For example, one might verbally refer to "gravity" while using the symbol "g" to represent it mathematically. Both expressions represent the same thing. The variables and the quantities they represent used in the equations below likewise represent physical, real world quantities in the downhole environment, both measured and calculated. They therefore are not abstractions and the equations representing them are not abstractions, but rather descriptions of tangible, physical objects and conditions. Each variable will be defined as it appears in the course of the discussion. However, for convenience, they are also collected in Table 3 toward the end of this detailed description.

The equations discussed below model the transient hydraulics and well-formation interactions in single and multiphase flow. The drill string and annulus will be spatially discretized and balance relations and closure equations are defined for each discrete space. The physical effects estimated in the model are the frictional pressure loss, both for single and two phase flows; pressure loss in bit; viscosity variations with pressure, temperature and composition of the mud; density variations with pressure, temperature and gas content of the mud; dynamics of gas dissolution in mud (non-equilibrium); rise in gas velocity as it expands up the annulus; and simple reservoir dynamics including permeability and porosity of reservoir (when a reservoir model is included).

The model assumes that all variables are dependent on only one spatial coordinate—length along flow line. Effects from cross-sectional, non-uniform velocity and mass distribution profiles are neglected. It is also assumed that temperature at each point along the flow line is known. (This is an input to the model based on estimates or measurements made elsewhere.) Additional assumptions include that gas in the flow line can exist either as free gas or dissolved gas; gas and mud pressures at the same point are assumed to be equal; and gas is insoluble in water-based mud, hence single phase flow. The system is treated as a black oil system, one that is able to predict compressibility and mass transfer effects between phases in a reservoir as it is depleted.

The conservation of mass and momentum for a compressible fluid form the fundamental governing equations for this engineering problem. Though flow is assumed to be one-dimensional inside a cylindrical pipe or annular region, cross-sectional geometric flexibility is accommodated through a variable diameter formulation. This discussion begins first by presenting the relevant equations for a single-phase flow and then expands on this formulation for multi-phase flow.

In one dimension, the governing equations for a single-phase (mud) flow in conservative form are as follows:

$$\frac{\partial(\rho_m A)}{\partial t} + \frac{\partial(\rho_m u_m A)}{\partial x} = 0 \tag{1}$$

and $$\frac{\partial(\rho_m u_m A)}{\partial t} + \frac{\partial(\rho_m u_m^2 A)}{\partial x} + A\frac{\partial P}{\partial x} = F_f - \rho_m g \tag{2}$$

where $\rho_m$ is the mud density, A is the local hydraulic diameter, t is time, $u_m$ is the mud flow velocity in the x direction, x is a spatial coordinate, $F_f$ is a frictional force term discussed further below and included to model viscous effects, P is the pressure of the fluid, and g is a gravity acceleration.

For single-phase flow, the density of mud, $\rho_m$, is derived from correlations for slightly compressible fluids as follows:

$$\rho_m = \rho_{m_{sc}}\left[\frac{1 + c_t(T - T_{sc})}{1 - \frac{P - P_{sc}}{E}}\right] \tag{3}$$

where $\rho_{m_{sc}}$, $T_{sc}$, and $P_{sc}$ are the density, temperature and pressure of mud at standard conditions, respectively, and T is temperature, P is pressure, and E is a volume modulus. The parameter $c_t$ is the mud compressibility constant. These parameters are considered model input such that $\rho_m$ can be calculated directly given the local pressure and temperature, (P, T).

Additional pressure losses incurred from fluid friction are calculated using empirical correlations. For single phase flow, the friction loss term, $F_f$ is given by:

$$F_f = (8.06600x10^{-4})\frac{f\rho_m u_m^2}{d_h} \tag{4}$$

where $d_h$ is the local hydraulic diameter and $f$ is a friction factor that is determined separately depending on whether the local flow is laminar or turbulent. For laminar flow ($Re<Re_L$, where Re is the Reynolds number and $Re_L$ is the highest Reynolds number limit for laminar flow), $$f = \frac{64}{R_e} \tag{5}$$

and for turbulent flow ($Re \geq Re_T$, where Re is the Reynolds number and $Re_T$ is the lower Reynolds number for turbulent flow), $$f = a(Re)^{-b} \tag{6}$$

where $$a = \frac{\log(n) + 3.95}{12.5} \tag{7}$$

-continued $$b = \frac{1.75 - \log(n)}{7} \tag{8}$$

$$n = 3.32\log\left[\frac{\sigma_{yp} + 2\mu_p}{\sigma_{yp} + \mu_p}\right] \tag{9}$$

where $\sigma_{yp}$ is the yield point and $\mu_p$ is the fluid plastic viscosity of the fluid in the wellbore for a Bingham plastic model of the fluid.

The local Reynolds number (Re) and associated transition points are computed as follows:

$$Re = \frac{0.23(u_m)^{2-n}(d_h)^n\rho_m}{k(8)^{n-1}} \tag{10}$$

$$Re_L = 3470 - 1370n \tag{11}$$

$$Re_T = 4270 - 1370n \tag{12}$$

where $$k = \frac{(\sigma_{yp} + 2\mu_p)k'}{100(1022)^n} \tag{13}$$

and $$k' = \left[\frac{3n+1}{4n}\right]^n \tag{14}$$

for the drill string, and $$k' = \left[\frac{2n+1}{2n}\right]^n \tag{15}$$

for the annulus.

To model flows which may include some distribution of kick hydrocarbon in the early flow dynamics using oil-based mud, a multi-phase flow solver is desired. The model used here is based on tracking three constituents: the free gas in the system, the gas dissolved in the drilling mud, and the drilling mud itself. The drilling mud is made up of water, oil, weighting solids, and dissolved gas. The governing principles are conservation of mass and conservation of momentum. Three conservation of mass equations are used: one each for the free gas, dissolved gas, and drilling mud. Conservation of momentum is expressed via a single partial differential equation governing the momentum of the entire mixture.

The governing equations take the following form. The various quantities used in Eq. (16) through Eq. (19) are collected in Table 1 for convenience. For mass conservation for the mud, the equation is:

$$\frac{\partial}{\partial t}(\rho_m A(1-\alpha)) + \frac{\partial}{\partial x}(\rho_m u_m A(1-\alpha)) = \dot{m}_g A. \tag{16}$$

For mass conservation for the dissolved gas:

$$\frac{\partial}{\partial t}(\rho_m A\varphi(1-\alpha)) + \frac{\partial}{\partial x}(\rho_m u_m A\varphi(1-\alpha)) = \dot{m}_g A. \tag{17}$$

For mass conservation for the free gas:

$$\frac{\partial}{\partial t}(\rho_g A\alpha) + \frac{\partial}{\partial x}(\rho_g u_g A\alpha) = -\dot{m}_g A + q. \tag{18}$$

And, for the momentum conservation for the entire mixture:

$$\frac{\partial}{\partial t}(\rho_m u_m(1-\alpha) + \rho_g u_g\alpha) + \frac{\partial}{\partial x}(\rho_m u_m^2(1-\alpha) + \rho_g u_g^2\alpha + p) = -F_f - (\rho_m(1-\alpha) + \rho_g\alpha)g\cos\theta \tag{19}$$

The models use a variety of variables that can be categorized as follows. The model employs two independent variables, time t (sec), and position x (ft). There are four "state variables": pressure p (lbm/(ft sec2)=144 g psia), mud velocity $u_m$ (ft/sec), volume fraction of free gas $\alpha$, and mass fraction of dissolved gas in mud $\varphi$. There are also six derived quantities: mud density $\rho_m$ (lbm/ft$^3$), rate of free gas dissolution $\dot{m}_g$ (lbm/(ft$^3$ sec)), density of free gas $\rho_g$ (lbm/ft$^3$), velocity of the free gas $u_g$ (ft/sec), free gas injection term q (lbm/ft sec), and force due to frictional effects $F_f$ (lbm/(ft$^2$ sec$^2$)). To close the system, the models define all the "derived quantities" in terms of the state variables (or other derived quantities that can be computed explicitly from the state variables) as well as the "given" quantities cross-sectional area A (ft$^2$), temperature T (° R), acceleration due to gravity g (ft/sec$^2$), and the wellbore angle from the vertical $\theta$.

These models are generally referred to as "submodels" or "closure models" and there are six of them: the mud density $\rho_m$, the free gas dissolution rate $\dot{m}_g$, the free gas density $\rho_g$, the free gas velocity $u_g$, the injection source q, and the frictional force $F_f$. There is a lot of literature concerning various options for these submodels. The choices used in this work will be discussed in detail below.

To write the partial differential equations above in a compact form, let V=[p, $u_m$, $\alpha$, $\varphi$] denote the primitive variables and $$U = \begin{bmatrix} \rho_m(1-\alpha)A \\ \rho_m\phi(1-\alpha)A \\ \rho_g\alpha A \\ \rho_m u_m(1-\alpha) + \rho_g u_g\alpha \end{bmatrix} \tag{20}$$

denote the conserved variables. Given appropriate submodels, the conserved variables can be computed from the primitive variables and the given quantities. Letting the given quantities be denoted by W=[A, T, $\theta$], we have $$U=U(V;W). \tag{21}$$

Further, let F=F(V;W) and S=S(V;W) denote the fluxes and sources, respectively, in Eq. (16) through Eq. (19). Specifically, $$F = \begin{bmatrix} \rho_m u_m(1-\alpha)A \\ \rho_m\phi u_m(1-\alpha)A \\ \rho_g\alpha A \\ \rho_m u_m^2 + \rho_g u_g^2 + p \end{bmatrix}, \tag{22}$$

-continued $$S = \begin{bmatrix} \dot{m}_g A \\ \dot{m}_g A \\ -\dot{m}_g A + q \\ F_f - (\rho_m(1-\alpha) + \rho_g \alpha) g \cos\theta \end{bmatrix}.$$

Then, Eq. (16) and Eq. (19) can be written in the following compact form:

$$\frac{\partial U(V;W)}{\partial t} + \frac{\partial F(V;W)}{\partial x} = S(V;W) \tag{23}$$

Procedures for discretizing Eq. (20) are described below.

TABLE 1

Variables appearing in Eq. (16) through Eq. (19).

| Variable | Description | Classification | Units |
|---|---|---|---|
| t | Time | Independent variable | (sec) |
| x | Position | Independent variable | (ft) |
| $\rho_m$ | Mud density | Derived quantity | (lbm/ft$^3$) |
| A | Cross-sectional area | Given | (ft$^2$) |
| $\alpha$ | Volume fraction of free gas | State variable | (—) |
| $u_m$ | Velocity of the mud | State variable | (ft/sec) |
| $\dot{m}_g$ | Rate of free gas dissolution | Derived quantity | (lbm/(ft$^3$sec)) |
| $\varphi$ | Mass fraction of dissolved gas in mud | State variable | (—) |
| ρg | Density of the free gas | Derived quantity | (lb m/ft$^3$) |
| ug | Velocity of the free gas | Derived quantity | (ft/sec) |
| q | Free gas injection term | Derived quantity | (lbm/(ft sec) |
| p | Pressure | State variable | (lbm/(ft sec$^2$)) = 144 g (psia) |
| $F_f$ | Force due to frictional effects | Derived quantity | (lbm/(ft$^2$sec$^2$)) |
| g | Acceleration due to gravity | Given (constant) | (ft/sec$^2$) |
| θ | Wellbore angle (from vertical) | Given | (—) |

The multi-phase governing equations given above benefit from closure relationships for a number of quantities. These quantities include: the density of the free gas, $\rho_g$; the density of the mud, $\rho_m$; the velocity of the free gas, $u_g$; the friction or viscous force, F, the rate of gas dissolution, $\dot{m}_g$; and the gas influx rate, q. As promised above, the models used in this work will now be discussed in detail.

The free gas density $\rho_g=\rho_g(p, T)$ is determined using the following relationship:

$$\rho_g = \frac{p\delta_g M_a}{\mathcal{R}TZ} \tag{24}$$

where $\mathcal{R}$ is the universal gas constant, $M_a$ is the molecular mass of air, $\delta_g$ is the specific gravity of the gas (the ratio of the gas density to the density of air at standard conditions), Z is the "compressibility factor", and T is the temperature.

Except for z, Eq. (24) is the ideal gas law. Thus, the compressibility factor is a dimensionless number that accounts for the departure of the gas from ideal gas behavior. It is computed from the Hall-Yarborough correlation:

$$z = \frac{0.06125 p_{pr} t_r \exp(-1.2(1-t_r)^2)}{y} \tag{25}$$

where $p_{pr}$ is the pseudo reduced pressure ratio, $t_r$ is the reciprocal pseudo reduced temperature ratio, and y is the reduced density. The pseudo reduced pressure ration and inverse pseudo reduced temperature ratio are given by $$p_{pr} = \frac{p}{p_c},\ t_r = \frac{1}{T_{pr}} = \frac{T_c}{T}. \tag{26}$$

Correlations are then used to compute the critical pressure and temperature:

$$p_c = 667 + 15\delta_g - 37.5\delta_g^2 \tag{27}$$

$$T_c + 168 + 325\delta_g - 12.5\delta_g^2. \tag{28}$$

Finally, y is given by solving the following nonlinear equation:

$$A(p_{pr}, t_r) + \frac{y + y^2 + y^3 - y^4}{(1-y)^3} - B(t_r)y^2 + C(t_r)y^{D(t_r)} = 0, \tag{29}$$

where $$A(p_{pr}, t_r) = -0.06125 p_{pr} t_r \exp(-1.2(1-t_r)^2), \tag{30}$$

$$B(t_r) = 14.76t_r - 9.76t_r^2 + 4.58t_r^3, \tag{31}$$

$$C(t_r) = 90.7t_r - 242.2t_r^2 + 42.4t_r^3, \tag{32}$$

$$D(t_r) = 2.18 + 2.82t_r \tag{33}$$

Turning now to mud density, for clarity and simplicity, we first consider the case where there is no gas dissolved in the oil. We then generalize to include the effect of the dissolved gas.

When there is no gas dissolved in the oil that makes up part of the mud, the mud density is given by $$\rho_m = \rho_m(p; T, \chi_w, \chi_o, \chi_s) = \left(\frac{\chi_w}{\rho_w(p,T)} + \frac{\chi_o}{\rho_o(p,T)} + \frac{\chi_s}{\rho_s}\right)^{-1}, \tag{34}$$

where $\chi_w$, $\chi_o$, and $\chi_s$ are the mass fractions of the water, oil, and solids (weighting materials) within the mud and $\rho_w$, $\rho_o$, and $\rho_s$ are the respective densities. The weighting materials are incompressible and thus $\rho_s$ is a constant, but the densities of the water and oil depend on p and T. For example, the following correlations have been proposed:

$$\rho_o = A_0 + A_1 T + A_2 p, \tag{35}$$

$$\rho_{ow} = AB_0 + B_1 T + B_2 p, \tag{36}$$

where $A_0=7.24032$, $A_1=-2.84383\times10^{-3}$, $A_2=2.75660\times10^{-5}$, $B_0=8.63186$, $B_1=-3.31977\times10^{-3}$, $B_2=2.37170\times10^{-5}$.

Note that these correlations use (lbm/gal) for density, (° F.) for temperature, and (psia) for pressure. Thus, appropriate unit conversions are performed to use these results.

In the case where gas is dissolved in the oil, Eq. (34) through Eq. (36) are modified to accordingly. It is assumed here that the gas is insoluble in the water component of the mud. Thus, all the dissolved gas in the mud is dissolved into the oil. In this situation, recalling that φ denotes the mass fraction of the dissolved gas in the mud, we have $$\rho_m = \rho_m(p, \phi; T, \chi_w, \chi_o, \chi_s) = \left(\frac{\chi_w(1-\phi)}{\rho_w(p, T)} + \frac{\chi_o(1-\phi)+\phi}{\rho_{go}(p, T, \phi)} + \frac{\chi_s(1-\phi)}{\rho_s}\right)^{-1}, \tag{37}$$

where $\chi_w$, $\chi_o$, and $\chi_s$ are the mass fractions of water, oil, and solids for the original mud—i.e., before any gas dissolves in the oil. Note that as $\varphi \rightarrow 0$, Eq. (37) goes to Eq. (34) assuming that the same water density model is used in both cases and that $\rho_{og}(p, T, 0) = \rho_o(p, T)$.

It is common to express the density of the oil with dissolved gas in terms of two ratios: the gas/oil ratio $R_s$ and the oil formation volume factor $B_o$. These quantities are defined as follows:

$$R_s = \frac{\text{volume of gas dissolved in oil (at standard conditions)}}{\text{volume of pure oil (at standard conditions)}} = \frac{V_{g,sc}}{V_{g_{o,sc}}} \tag{38}$$

and $$B_o = \frac{\text{volume of oil (with dissolved gas) at actual conditions}}{\text{volume of pure oil (at standard conditions)}} = \frac{V_{o,g}(p, T)}{V_{o,sc}}$$

Then, the density of the oil with dissolved gas can be written as $$\rho_{og} = \frac{\rho_{o,sc} + \rho_{g,sc} R_s}{B_0} \tag{40}$$

where $\rho_{o,sc}$ is the density of the oil at standard conditions and $\rho_{g,sc}$ is the density of the gas at standard conditions.

Thus, to compute $\rho_{og}$ one computes $R_s$ and $B_o$ from p, T, and φ. While there are many correlations for the gas/oil ratio in terms of p and T, these are unnecessary here because the mass fraction of dissolved gas is known.

$$R_s = \frac{\phi}{\chi_o(1-\phi)} \frac{\rho_{o,sc}}{\rho_{g,sc}} \tag{41}$$

Substituting Eq. (41) into Eq. (40) gives $$\rho_{og} = \frac{\rho_{o,sc}}{B_0}\left[1 + \frac{\phi}{\chi_o(1-\phi)}\right] \tag{42}$$

To complete the model, a correlation for $B_o$ is desired. Many such correlations are available in the literature. In the illustrated embodiment, the correlation for $B_o$ depends on the bubble point pressure $p_b$ and the formation volume factor at the bubble point pressure, $B_{ob}$. Specifically, $$B_o = B_{ob}\left(\frac{p}{p_b}\right)^C. \tag{43}$$

Correlations for $B_{ob}$, $p_b$, and C are given below. Note that the correlation used for C depends on whether the local pressure is greater or less than the bubble point pressure. The bubble point pressure is computed from $$p_b = a_1\left[\left(\frac{R_s}{\delta_g}\right)^{a_2} 10^{(a_3 T - a_4 \delta_{oAPI})} - a_5\right] \tag{44}$$

where the parameters are $$a_1 = 0.972, \quad a_2 = 1.472 \times 10-4, \quad a_3 = 0.5, \quad a_4 = 1.25, \quad a_5 = 1.175, \text{ and } \delta_{oAPI} = \frac{141.5}{\delta_o} - 131.5 \tag{45}$$

Finally, note that T in Eq. (44) is in ° F.

The formation volume factor at bubble point pressure is computed from $$B_{ob} = 1 + a_1 R_s + a_2 R_s + a_2 R_s \frac{\delta_g}{\delta_o} + a_3 R_s (T-60)(1-\delta_o) + a_4 (T-60). \tag{46}$$

where $$a_1 = 0.177342 \times 10^{-3}, \; a_2 = 0.220163 \times 10^{-3}, \; a_3 = 4.292580 \times 10^{-6}, \; a_4 = 0.528707 \times 10^{-3}.$$

When $p > p_b$, the exponent C in Eq. (43) is given by $$C = \alpha_5 R_s + \alpha_6 R_s^2 + \alpha_7 \delta_g + \alpha_8 (T+460)^2 \tag{47}$$

where $$a_5 = -0.0136680 \times 10^{-3}, \; a_6 = -0.0195682 \times 10^{-6}, \; a_7 = 0.02408026, \; a_8 = 0.926019 \times 10^{-6}.$$

Finally, when $p < p_b$, $$C = a_g (T+460) + a_{10} \log \delta_g + a_{11} \delta_o + a_{12} \log\left(\frac{p}{p_b}\right) + a_{13}\left(\frac{p}{p_b}\right) + a_{14} \log \delta_o \tag{48}$$

where $$a_9 = -0.35279600 \times 10^{-3}, \quad a_{10} = -0.35328914, \quad a_{11} = -0.24964270, \quad a_{12} = 0.08685097, \quad a_{13} = 0.36432305, \quad a_{14} = 1.64925964.$$

The free gas moves relative to the drilling mud. Thus, a free gas velocity model is used to close both the free gas mass conservation and the momentum equations. The model used here expresses the free gas velocity as $$u_g = C_o u_{mix} + u_s, \tag{49}$$

where $u_g$ is the free gas velocity, $u_{mix}$ is the gas/mud mixture velocity, and $u_s$ is the slip velocity. The mixture velocity is given by $$u_{mix} = u_m(1-\alpha) + u_g \alpha. \tag{50}$$

Substituting Eq. (50) into Eq. (49) and solving for $u_g$ gives $$u_g = \frac{C_o u_m(1-\alpha) + u_g}{1 - C_o\alpha} \tag{51}$$

To complete the model, a correlation for the slip velocity is introduced. Here, a very simple slip velocity is used. Experiments by others in the art indicate that the gas rise velocity in oil-based mud is essentially independent of the volume fraction of free gas, perhaps because the large slug-type bubbles form at very low free gas volume fractions. Based on these experiments, we adopt the following simple model:

$$u_s=(0.345+0.1r)\sqrt{gd} \tag{52}$$

where d is the outer diameter of the annulus and r is the ratio of the inner diameter to the outer diameter (i.e., for a pipe r=0).

This model is, for vertical wells and can represent deviated wells through an angle correction. The angular correction has not been implemented here but those in the art having the benefit of this disclosure will be able to add it if it is found necessary or desirable. Similarly, there are other models known to the art that may be suitable. These may be used in alternative embodiments. Indeed, any suitable model known to the art may be used.

Turning now to the friction factor, the force due to friction on the right-hand side of the momentum equation is modeled as $$F = \frac{2f\rho_{mix}u_{mix}^2}{d_H} \tag{53}$$

where $d_H$ is the hydraulic diameter and $f$ is the friction factor. The friction factor is determined as $$f=f_{ns}\exp S. \tag{54}$$

where $f_{ns}$ is the "no-slip" friction factor. For the no-slip friction factor, $$f_{ns} = \left[2\log_{10}\left(\frac{Re}{4.5223\log_{10}(Re) - 3.8215}\right)\right]^{-2} \tag{55}$$

where $$Re = \frac{\rho_{mix}u_{mix}d_H}{\mu_{mix}} \tag{56}$$

$$\mu_{mix} = \mu_p(1-\alpha) + \mu_g\alpha, \tag{57}$$

and $\mu_p$ and $\mu_g$ are the viscosities of the mud and free gas, respectively. Note that this friction factor is just that given by the "smooth wall" curve on the Moody diagram. Further, this friction factor is based on data for pipe flow of Newtonian fluids. Thus, some embodiments may choose to use a correction to account for the non-Newtonian nature of the drilling mud.

The quantity S in the correction that accounts for multiphase flow is given by $$S = \frac{\log(y)}{-0.0523 + 3.182\log(y) - 0.8725[\log(y)]^2 + 0.01853[\log(y)]^4}, \tag{58}$$

where $$y = \frac{\lambda}{(1-\alpha)^2}, \tag{59}$$

and λ is the "input liquid content":

$$\lambda = \frac{q_m}{q_m + q_g} \tag{59}$$

$$= \frac{u_m A_m}{u_m A_m + u_g A_g} \tag{60}$$

$$= \frac{u_m A(1-\alpha)}{u_m A(1-\alpha) + u_g A\alpha} \tag{61}$$

$$= \frac{u_m(1-\alpha)}{u_m(1-\alpha) + u_g\alpha}. \tag{62}$$

Thus, $$y = \frac{u_m}{[u_m(1-\alpha) + u_g\alpha](1-\alpha)} \tag{63}$$

Equation (63) has a singularity near y=1 (slightly greater than 1), and so, when 1<y<1.2, one can replace Eq. (63) with $$S=\log(2.2y-1.2). \tag{64}$$

At y=1, this switch is continuous. At y=1.2, it is not (but the discontinuity appears fairly small). The derivatives with respect toy are not continuous on either side.

The rate at which free gas dissolves into the mud is dependent on many factors, including the solubility of the gas in oil (as measured, e.g., by the gas/oil ratio at saturation), the "distance" from the saturated state (as measured by the difference between the actual gas/oil ratio and the saturation gas/oil ratio), and many other factors. Unfortunately, the literature on gas kick simulation does not fully specify an appropriate model for this effect. The illustrated embodiments employ a non-equilibrium model primarily based on dimensional analysis and some assumptions. This will allow us to begin simulations and investigate the sensitivity of the results to features of this model.

As a starting point for the model, we consider the following model form for dissolution:

$$\frac{dC}{dt} = k(C_s - C) \tag{65}$$

where C is the concentration (moles of solute per unit volume of solution), $C_s$ is the concentration at saturation (i.e., the solubility), and k is a rate constant. Multiplying Eq. (65) by the molar mass of solute M (gas in our case) gives $$\frac{dMC}{dt} = k(MC_s - MC) \tag{66}$$

Since $$MC = \frac{\text{mass of gas}}{\text{total volume}} = \phi\rho_m \tag{67}$$

We have $$\dot{m}=\rho_g k(\varphi_s-\varphi) \tag{68}$$

The mass fraction of dissolved gas at saturation $\varphi_s$ can be computed from a correlation for the gas/oil ratio at saturation and hence will depend on p and T.

When the mud is entirely made up of oil (such that $\varphi$ is the mass fraction of dissolved gas in the oil), we have the following:

$$R_s = \frac{\phi}{(1-\phi)}\frac{\rho_{o,sc}}{\rho_{g,sc}} \Rightarrow \phi = \frac{R_s}{\left(\frac{\rho_{o,sc}}{\rho_{g,sc}}\right)+R_s} \tag{69}$$

Thus, $$\phi_s = \frac{R_{s,sat}}{\left(\frac{\rho_{o,sc}}{\rho_{g,sc}}\right)+R_{s,sat}} \tag{70}$$

where the gas/oil ratio at saturation can be computed via a correlation:

$$R_{s,sat} = \left(\frac{p}{aT^b}\right)^n \tag{71}$$

For hydrocarbon gas in base oil, $$a=1.922 \quad b=0.2552$$

$$n=0.3576+1.168\gamma_g+(0.0027-0.00492\gamma_g)T-(4.51\times10^{-6}-8.198\times10^{-6}\gamma_g)T^2,$$

where $\gamma_g$ is the specific gravity of the gas (e.g., $\gamma_g$=0.6409 for natural gas) and the temperature T is given in °F. Note that this correlation gives $R_{s,sat}$ in scf/bbl. To convert this to $ft^3/ft^3$, divide the result by 5.61458.

To complete the model, specify k, the rate constant. The illustrated embodiments uses the following definition:

$$k = C_o\frac{\alpha(u_g-u_m)}{D_o^2-D_s^2}, \tag{72}$$

where $C_o$ is a constant.

The model for gas influx is specified at known location and time. Recall from Eq. (18):

$$\frac{\partial}{\partial t}(\rho_g A\alpha)+\frac{\partial}{\partial x}(\rho_g u_g A\alpha) = -\dot{m}_g A + q. \tag{18}$$

Gas influx rate, q, is specified using a simple linear model:

$$q(y,p) = \begin{cases} C_q(P_R - P(y)), & \text{for } y \text{ in reservoir and } P < P_R \\ 0, & \text{otherwise} \end{cases} \tag{73}$$

where $C_q$ is a reservoir constant specified to give a desired flow rate for pressure, P(y), at varying reservoir depths, y. Alternative embodiments may employ alternative models.

The partial differential equations documented here can be discretized using a large variety of different methods. This section describes some of those methods will now be discussed. For the purposes of compactly describing the different methods, the notation introduced in Eq. (23) is used throughout this discussion.

Let $\{x_0, x_1, \ldots, x_n\}$ denote a partition of the domain $\Omega$, and let $\Omega_i=(x_i, x_{i+1})$ for i=0, . . . , n−1. Further, let $$U_i(t) = \frac{1}{h_i}\int_{\Omega_i} U(x,t)\,dx \tag{74}$$

where $h_i=x_{i+1}-x_i$ and $U_i$ is the cell-average of u on the ith cell. Integrating Eq. (23) over $\Omega$i gives $$h_i\frac{\partial U_i}{\partial t} + F_{i+1}(t) - F_i(t) = hS_i(t), \tag{75}$$

where $F_{i+1}$ and $F_i$ are the flux at $x_{i+1}$ and $x_i$, respectively, and $S_i$ is the cell-average source term. These fluxes and sources cannot be computed exactly given only the cell-averaged quantities. Instead, generic cell-centered finite volume methods are derived by developing approximations for these terms.

The Lax-Friedrichs method is written as follows:

$$U_j^{n+1} = \frac{1}{2}(U_{j-1}^n + U_{j+1}^n) - \frac{\Delta t}{2h}(F_{j+1}^n - F_{j-1}^n) + \Delta t S_j^n \tag{76}$$

where $F_j^n$ is the flux evaluated using the state in cell j at time n. The method can be shown to be first-order in both space and time and is monotone. Further, it is very easy to implement and very robust. Thus, it represents a good scheme to start with, allowing development and testing of the physical models described earlier. However, it is well-known to be very diffusive, even compared to other first-order methods.

The Roe scheme can be written as follows:

$$U_j^{n+1} = U_j^n - \frac{\Delta t}{h}\left(\hat{F}_{j+1/2}^n - \hat{F}_{j-1/2}^n\right) + \Delta t S_j^n, \tag{77}$$

where $\hat{F}_{j+1/2}^n$ is a Roe-flux function. The Roe flux can be written as follows:

$$\hat{F}_{j+1/2}^n = \frac{1}{2}(F_{j+1}^n + F_j^n) - \frac{1}{2}Q, \tag{78}$$

where $$Q=|\hat{A}(U_{j+1}^n, U_j^n)|(U_{j+1}^n - U_j^n), \tag{79}$$

and $\hat{A}$ is any matrix such that $$\hat{A}(U_{j+1},U_j)(U_{j+1}-U_j)=F(U_{j+1})-F(U_j); \tag{80}$$

$\hat{A}(U_{j+1},U_j)$ is diagonalizable with real eigenvalues; and $$\hat{A}(U_{j+1},U_j)\rightarrow A(U) \text{ as } U_{j+1},U_jU, \text{ where } A=\partial F/\partial U. \tag{81}$$

For some systems—e.g., the Euler equations—it is straightforward to analytically construct such a matrix $\hat{A}$. However, for the general multi-phase flow equations with complex submodels used here, this is not at all trivial. Instead, we use a "numerical" Roe matrix. The matrix $\hat{A}$ is computed by the following procedure.

First, compute an average conserved state vector $U_m$ by computing the conserved state corresponding to the average of the primitive states on the left and right of the interface. For j+½ this is given by $$V_m = \frac{1}{2}(V_{j+1} + V_j),\ W_m = \frac{1}{2}(W_{j+1} + W_j),\ U_m = U(V_m, W_m). \tag{82}$$

Next, evaluate the flux Jacobian A=dF/dU at this average state:

$$A_m = A(U_m) = \frac{dF}{dV}\bigg|_{V_m,W_m}\left(\frac{dU}{dV}\bigg|_{V_m,W_m}\right)^{-1} \tag{83}$$

Then modify $A_m$ to satisfy the first criterion set forth above. Specifically, find a diagonal matrix $\hat{\Lambda}$ such that $$R\hat{\Lambda}R^{-1}(U_{j+1}-U_j)=F(U_{j+1})-F(U_j), \tag{84}$$

where R are the eigenvectors of $A_m$. Letting $\Lambda$ be the diagonal matrix of eigenvalues of $A_m$, we find $\hat{\Lambda}$ by letting $\hat{\Lambda}=\Lambda+\delta\Lambda$ where $$\delta\Lambda = \begin{bmatrix} \delta\lambda_0 & & & \\ & \delta\lambda_1 & & \\ & & \delta\lambda_2 & \\ & & & \delta\lambda_3 \end{bmatrix}, \tag{85}$$

$$\delta\lambda_i = \frac{(R^{-1}(\Delta F - A\Delta U))_i}{(R^{-1}\Delta U)_i}.$$

Figure 5:
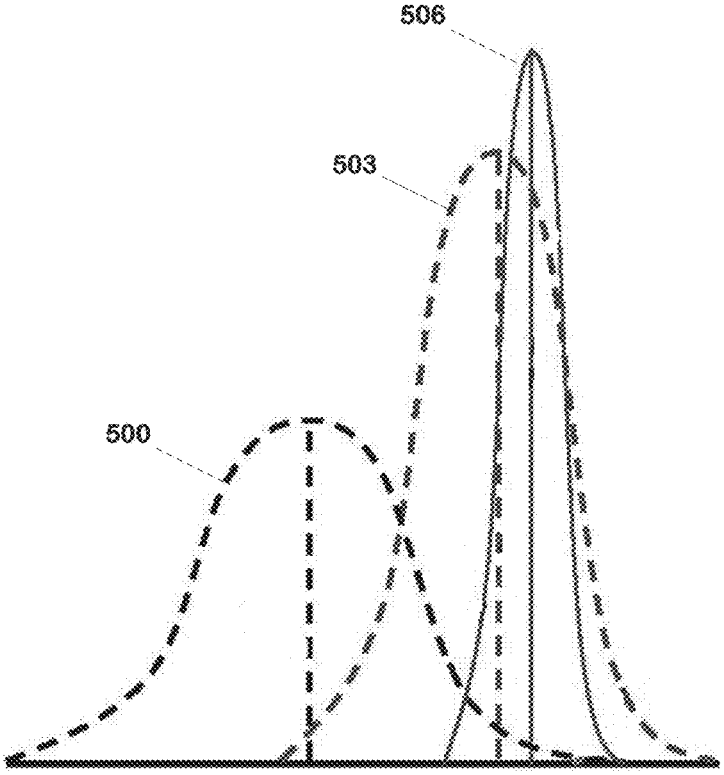
FIG. 5-FIG. 6 convey how combining multiple models/predictions of the same quantity gives significantly reduced uncertainty in the estimated value.
Figure 6:
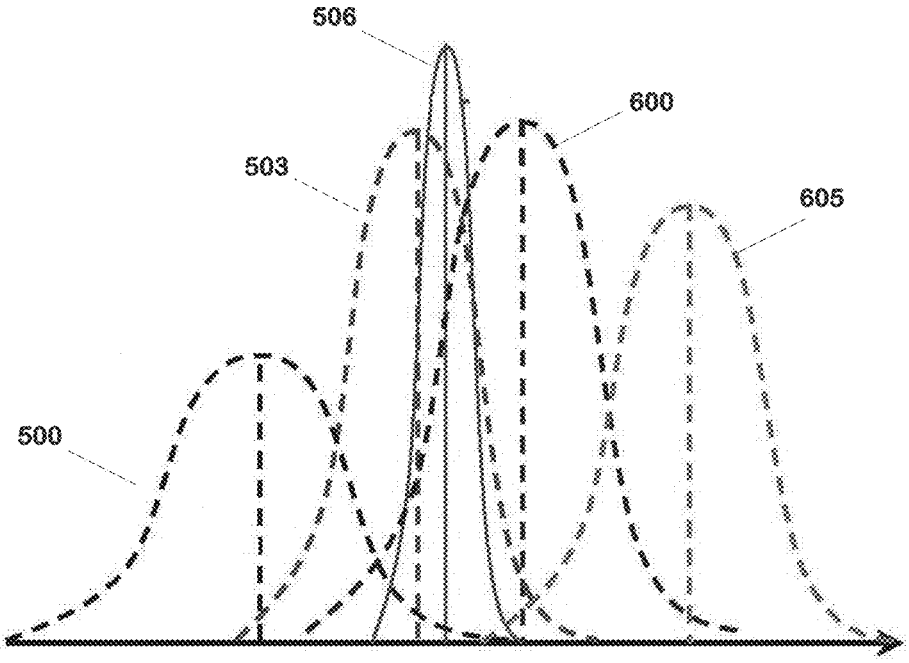

The above may be referred to as a "Distributed Hydraulics Model", or "DHM", and may be employed in some embodiments. However, alternative embodiments may use other types of models such as the "Lumped Parameter Model". The Lumped Parameter Model, or "LPM", provides a real-time tool for monitoring well processes as well as detection of reservoir influx at the bottom hole. It models well hydraulics and combines it with well measurements in an optimal way that accounts for uncertainties in each as shown in FIG. 5 and FIG. 6. It also incorporates a Confidence Interval on the Expected Value which establishes a bound on the estimated variables including any influx. This serves to help eliminate false positives. The LPM selectively combines several subsidiary techniques including flow measurement and well monitoring systems, flow models for predictive systems, and probabilistic models.

Flow measurement and well monitoring systems include flow meters, mud pit volume sensors and stand pipe pressure gages. Typically, a kick threshold for any or all of these parameters is set and the system generates an alarm if the set maximum is exceeded. Many different types of flow meters are in use today. In practice, the kick threshold for outflow rate is set at a specific value of outflow minus inflow, known as delta flow. This precludes the need for continual resetting of alarm levels when drilling conditions demand a change in the inflow rate.

Flow models for predictive systems include process models, which have found increasing use in kick prediction with the availability of high speed computers. Real-time, advanced mathematical models incorporating multi-phase flow, torque and drag models as well as several sub-models, compute flow out and other well parameters as the drilling process progresses using inputs from installed sensors along the flow line. This is then compared to real-time well data and any discrepancy is used as a predictor of kick or other drilling anomalies.

Probablistic models use a model matching framework based on Bayesian probability. Kicks of different types and rates are modeled and compared to real-time data using Bayes rule. Other rig activities are also modeled to reduce incidences of false positives. The system outputs the kick probability at each data point and when it exceeds a set threshold (90%), an alarm is raised. It uses flow out/flow in comparison as the primary kick indicator. It is claimed to have high, adaptable sensitivity with low false alarm rate. It is also rig independent, requires little or no calibration and can use crude flow meters like the paddle meter.

Figure 7:
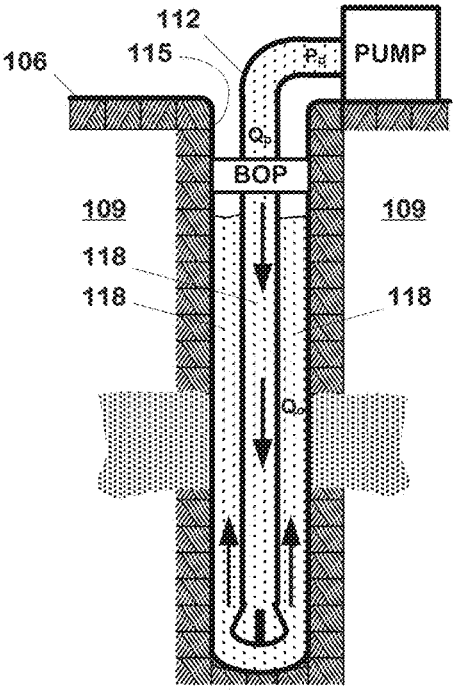
FIG. 7 depicts selected portions of a well system for purposes of illustrating a particular model thereof.
Figure 8:
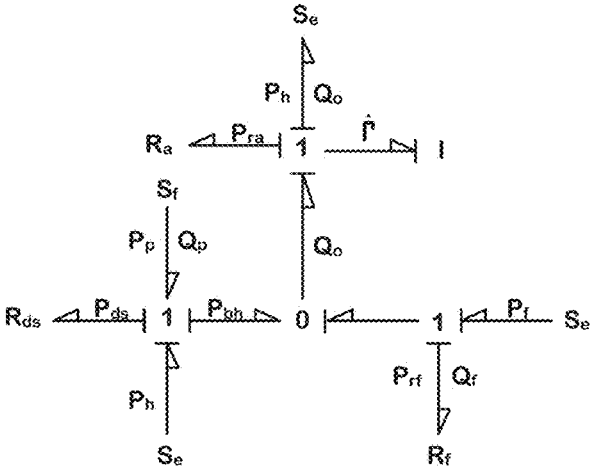
FIG. 8 is a bond graph model from which process and measurement equations may be obtained for the wellbore and well reservoir hydraulics of the well system of FIG. 7.

For the LPM model, rather than the complex multi-phase flow models described above, which involve solving partial differential equations of mass, momentum and energy conservation, wellbore hydraulics is simplified into time-only dependent mathematical models with the wellbore lumped as a single block as illustrated in FIG. 7. Process and measurement equations are obtained from a bond graph model such as that in FIG. 8 of wellbore and well reservoir hydraulics. The equations are then linearized and transition matrices obtained. These matrices form a basic component of the Linearized Kalman filter used.

Several assumptions are made in simplifying the wellbore hydraulics. These include, for example, influx enters the wellbore at the same density as the drilling mud and remains at this density for the early stage of kick detection. Hence, only a single liquid phase is considered. The fluid is incompressible. This proceeds from the assumption of a single liquid phase. Nonlinear, square law pressure drop assumed for drill pipe and bottom hole assembly, $R_{ds}$, and annulus, $R_a$. Reservoir pressure is modeled as a non-zero mean random walk where the bias and diffusion strength are known from experimental data. Mud inflow rate is known hence there is no need to include the drill string fluid momentum subsystem.

The result is two state functions. The first one, the fluid momentum, $\Gamma$, describes the wellbore-reservoir hydraulics, and the second, the mud pit volume change, $V_g$, as a result of well influx.

$$\dot{\Gamma}=P_f-P_h-P_{rf}-P_{ra} \tag{86}$$

$$\dot{V}_g=Q_o-Q_p \tag{87}$$

Where the constitutive relationships are given by:

$$Q_o = \frac{1}{I}\Gamma \tag{88}$$

$$Q_f = Q_o - Q_p \tag{89}$$

-continued $$P_{rf} = R_f Q_f = R_f(Q_o - Q_p) \tag{90}$$

$$P_{ra} = \frac{R_a}{I^2}\Gamma^2 \tag{91}$$

The two state equations become, $$\Gamma = P_f - R_f\left(\frac{\Gamma}{I} - Q_p\right) - \frac{R_a}{I^2}\Gamma^2 - P_h \tag{92}$$

$$\dot{V}_g = \frac{1}{I}\Gamma - Q_p \tag{93}$$

The proposed model is uncertain due to the simplifications assumed in the construction of the bond graph and the inherent measurement uncertainties in the data supplied from the wells. The dynamic system is augmented to include formation pressure, $P_f$, as a shaping filter for the random walk process.

$$P_{f_{n+1}}=P_{f_n}+wP_f \tag{94}$$

$$\Gamma_{n+1}=\Gamma_n+w\Gamma \tag{95}$$

$$V_{g_{n+1}}=V_{g_n}+wV_g \tag{96}$$

where formation pressure, is modeled as a random walk Gaussian process with zero mean and variance=$wP_f\delta t$, i.e., $wP_f$:N(0,$wP_f\delta t$, resulting in the evolution equation of the form $x_{n+1}=f(x_n)+w_n$, with $f$ as a deterministic mapping of the state vector, $x=[P_f\ \Gamma\ V_g]^T$ and $W_n$ as the additive noise associated with the process.

Three measurements are used for the process estimation as a basis for comparison with the state vector. These are the pump pressure, $P_p$, return flow, $Q_o$, and the mud pit volume, $V_{mp}$. They make up the observation vector, $y=[P_p, Q_o, V_{mp}]^T$, which has the form $y_n=H(x)+v_n$, where $$P_p = P_f + R_f\left(Q_p - \frac{\Gamma}{I}\right) + R_{ds}Q_p^2 - P_h + vP_p \tag{97}$$

$$Q_o = \frac{1}{I}\Gamma + vQ_o \tag{98}$$

$$V_{mp} = V_g + vV_{mp} \tag{99}$$

The measurement noise vector, $v_n$, is also modeled as an additive Gaussian process noise with zero mean and variance given by $vP_p$~N(0,$\sigma_{P_p}^2$), $vQ_0$~N(0,$\sigma_{Q_o}^2$), $vV_{mp}$~N(0, $\sigma_{V_{mp}}^2$).

The process estimation process consists of the calculation of the probability distribution of $x_n|y_{1:n}$, that is, the states, given all available measurements and the nonlinear models, $$x_n=f(x_{n-1})+w_{n-1} \tag{100}$$

$$y_n=h(x_n)+v_n \tag{101}$$

which has an initial, $x_0$, in the form of a random vector of mean $\mu=E[x_0]$, and $P_0=E[(x_0-\mu_0)(x_0-\mu_0)^T]$. A random vector, $w_{n-1}$, captures the uncertainties in the model while another random vector, $v_n$, captures the noise in the measurements. Both of them are described by:

$$E[w_n]=0;\ E[w_n w_m^T]=Q_n\delta_{nm} \tag{102}$$

$$E[v_n]=0;\ E[v_n v_m^T]=R_n\delta_{nm} \tag{103}$$

$$E[w_n v_n^T]=0 \tag{104}$$

One solution for linear Gaussian models is the Kalman filter. For nonlinear and/or non-Gaussian models, sequential Monte Carlo methods are used to construct approximate solutions.

The Kalman filter is based on a linear Gaussian model. For nonlinear, Gaussian systems, the Linearized Kalman filter and the Extended Kalman filter may be used to approximate the solution. These methods are based on linearization of the state and measurement functions about a steady state value, resulting in the following state and measurement matrices:

$$\begin{bmatrix} \dot{P}_f \\ \dot{\Gamma} \\ \dot{V}_g \end{bmatrix}_n = \begin{bmatrix} 0 & 0 & 0 \\ 1 & -\dfrac{R_f + 2R_a\Gamma/I}{I} & 0 \\ 0 & R_f/I & 0 \end{bmatrix}_n \begin{bmatrix} \delta P_p \\ \delta\Gamma \\ \delta V_g \end{bmatrix}_n \tag{105}$$

For a steady-state linearization about the inflow rate, we get a constant matrix for the Linearized Kalman case, given by $$\begin{bmatrix} \dot{P}_f \\ \dot{\Gamma} \\ \dot{V}_g \end{bmatrix}_n = \begin{bmatrix} 0 & 0 & 0 \\ 1 & -\dfrac{R_f + 2R_a Q_{pss}}{I} & 0 \\ 0 & R_f/I & 0 \end{bmatrix}_n \begin{bmatrix} \delta P_p \\ \delta\Gamma \\ \delta V_g \end{bmatrix}_n \tag{106}$$

The measurement matrices become:

$$\begin{bmatrix} \delta Q_o \\ \delta V_m p \\ \delta P_p \end{bmatrix}_n = \begin{bmatrix} 0 & 1/I & 0 \\ 0 & 0 & 1 \\ 1 & 0 & -R_f/I \end{bmatrix}_n \begin{bmatrix} \delta P_p \\ \delta\Gamma \\ \delta V_g \end{bmatrix}_n \tag{107}$$

which represent a continuous system of the form $$\dot{x}_n=A_c(x_n)\delta x_n \tag{108}$$

$$\delta y_n=C_c(x_n)\delta x_n \tag{109}$$

where $A_c$ and $C_c$ are the 3×3 continuous matrices above. These are converted to discrete time system using Zero Order Hold ("ZOH") transformation to obtain $$x_{n+1}=A_d(x_n)\delta x_n \tag{110}$$

$$\delta y_n=C_d(x_n)\delta x_n \tag{111}$$

where $A_d$ and $C_d$ are discrete matrices. This linearized discrete system is used in the Linearized Kalman Filter in Table 2.

TABLE 2

| Linearized Kalman Filter<br>Linearized Kalman Filter |
|---|
| Initialization |
| At time n = 0<br>$E[x_n] = x_0 - \mu_0$<br>$E[(x_0 - \mu_0)(x_0 - \mu_0)^T] = P_0$<br>Prediction |
| At time n ≥ 1<br>$\hat{x}_n = A_d(x_{n-1}$<br>$\hat{P}_n = A_d P_{n-1} A_d^T + Q_n$ |

TABLE 2-continued

| Linearized Kalman Filter<br>Linearized Kalman Filter |
|---|
| Update |
| $K_n = \hat{P}_n C_d^T (C_d \hat{P}_n C_d^T + R_n)^{-1}$<br>$\hat{x}_n = \hat{x}_n + K_n(y_n - h(\hat{x}_n))$<br>$P_n = (I - K_n C_d(\hat{x}_{n-1}))\hat{P}_n$ |

The submodels collect such information as well geometry, formation characteristics, mud properties, and information on current drilling maneuvers to calculate parameters used in process estimation and to make decisions on whether changes in the kick indicators are attributable to influx or to current well operations. The sub-models are described below:

The annular pressure drop is given by $P_{ra}=R_a Q_o^2$, where the annular pressure loss coefficient, $R_a$, is a constant obtained at the steady state inflow rate which is a known input into the system. The rheological model used to develop the friction pressure loss sub-model is the non-Newtonian, Power Law model. A preliminary annular pressure loss is calculated in field units as $$\Delta P_a = \frac{f\rho v^2}{25.8(d_2 - d_1)}\Delta l \tag{112}$$

where the friction factor, $f$, depends on whether the flow is laminar, turbulent or in transition as determined by the value of the dimensionless Reynold's number, $Re_f$ is found for laminar and turbulent flows as $$f=24/Re, \text{ for } Re<Re_{lam}=3470-1370n \tag{113}$$

$$f=aRe^{-b}, \text{ for } Re<Re_{turb}=4270-1370n \tag{114}$$

For transition flow, $f$ is interpolated between the two values above and given as $$f = \left(\frac{Re}{800}\right)aRe_{turb}^{-b} + \frac{24}{Re_{lam}}\left(1 - \frac{Re}{800}\right) \tag{115}$$

where, $$Re = 928\rho v(d_2 - d_1)/\mu \tag{116}$$

$$a = [\log(n) + 3.93]/50 \tag{117}$$

$$b = [1.75 - \log(n)]/7 \tag{118}$$

$$n = 3.32\log[(\tau_{yp} + 2\mu_p)/(\tau_{yp} + \mu_p)] \tag{119}$$

$$\mu = 100k\left(\frac{96v}{d_2 - d_1)}\right)^{n-1} \tag{120}$$

$$k = 5.1(\tau_{yp} + \mu_p)/511^n \tag{121}$$

The annular pressure loss coefficient is then calculated as $$R_a=\Delta P_a/Q_o^2 \tag{122}$$

For practical use in drilling operations, the model has to accommodate changing wellbore geometry for each bit run. Wellbore length or depth is calculated at each new time step by monitoring the rate of penetration ("ROP"), such that $$D_{wb} = D_{wb0} + \sum_{t}^{t+dt}(ROP \times dt) \tag{123}$$

Alongside the depth, wellbore area is also continuously monitored at each time step. Sections of uniform area have the same fluid inertia given by $$I_{ann}=\rho D_s/A_s \tag{124}$$

The different sections with different areas are aggregated to get the total fluid inertia:

$$I=\Sigma I_{ann} \tag{125}$$

The rate of penetration is determined using the following model:

$$ROP = \frac{dD}{dt} = e^{\left(a_1 + \sum_{j=2}^{8} a_j x_j\right)} \tag{126}$$

Where D is the true vertical depth, $a_1$ to $a_8$ are constant coefficients to be determined and $x_1$ to $x_8$ are drilling parameters. Eq. (126) can be written as $$ROP=f_1 \times f_2 \times f_3 \times f_4 \times f_5 \times f_6 \times f_7 \times f_8 \tag{127}$$

The function $f_1$ models the effect of parameters such as formation strength, mud type, bit type and solid content. This is given by, $$f_1=e^{2.303a_1} \tag{128}$$

The functions $f_2$ and $f_3$ model the effect of compaction thusly, $$f_2=e^{2.303a_2(10000-D} \tag{129}$$

$$f_3=e^{2.303a_3 D^{0.69}(g_p-9)} \tag{130}$$

The functions $f_4$, $f_5$, and $f_6$ model the effects of overbalance, weight on bit (WOB), and rotary speed respectively. Thus, $$f_4 = e^{2.303a_4 D(g_p-\rho_c)} \tag{131}$$

$$f_5 = \left[\frac{\frac{W}{d_b} - \left(\frac{W}{d_b}\right)_t}{4 - \left(\frac{W}{d_b}\right)_t}\right]^{a_5} \tag{132}$$

$$f_6 = \left(\frac{N}{60}\right)^{a_6} \tag{133}$$

Lastly, the functions $f_7$ and $f_8$ model bit tooth wear and bit hydraulics:

$$f_7 = e^{-a_7 h} \tag{134}$$

$$f_8 = \left(\frac{F_j}{1000}\right)^{a_8} \tag{135}$$

The LPM estimator adopts a simplified form of Eq. (127) based on Eq. (131), the overbalance function. This is shown in Eq. (136) below:

$$ROP = \frac{dD}{dt} = R_0 \exp^{(\Delta P_f / P_0)} \quad (136)$$

Where the effects represented by functions $f_1$ to $f_8$ barring $f_4$ have been concentrated in a nominal ROP, $R_0$. $P_0$ is a nominal pressure variation function, and $\Delta P_f = P_f - P_{bottomhole}$. $P_f$ is one of the state variables obtained from Eq. (106) at every time step.

In general, the LPM is advantageous relative to the DHM in that it uses existing rig process measurement data and continually updates this at every new data point as drilling progresses. No additional measurement parameter or equipment is needed. The system works within the uncertainties of sensors in current use, including the inaccurate flapper used for flow measurements. Set uncertainties for important variables increase noise tolerance and help keep false alarm rates at a minimum, if not totally eliminated. Rig and process specific data collection is minimal. It works on a broad range of rigs, from land rigs to deepwater well drilling. It uses mud pit volume increase as the primary kick indicator.

The volume of influx that trips the alarm can be set to any level acceptable to the drilling crew thereby accommodating differences in rig types and peculiarities. Even for deepwater wells, the procedure ensures that there is no time delay between an occurrence at the bottomhole and observation at the wellhead. Kicks or losses bottomhole cause immediate changes in the pump pressure which is used as the primary driver of the prediction process. Hence it ends up being a faster means of kick detection than outflow rate. The volume of influx taken in is known in real-time, with a confidence interval on the accuracy of results. Advantages of using pressure as the primary driver are harvested. These include: sensors do not fail due to gas flow; high accuracy of measurements; can predict flow rate as well; are a normal part of the rig system; fast reaction time to downhole changes.

On the other hand, the assumption of incompressible flow in the wellboare annulus may lead to over predicting the rate of influx into the well bore for slower kicks when some gas phase may be present. Increased friction pressure loss associated with this assumption may dampen this effect. Incompressible flow assumptions also give rise to immediate topside response to well bore influx, which may not be realistic when well breathing effects (elasticity in the mud/formation interaction are significant, or when gas phase material is present), or when significant topside mud fill and drainage occurs (within piping between the outflow meter and the mud pits).

The current LPM includes a model of the resistance to flow between the well bore and the formation which is linearized and therefore independent of the direction of flow. A non-linear resistance, which is dependent on flow direction can be added to the LPM. Estimation of the resulting non-linear model can be obtained by non-linear estimation methods such as statistical linearization and Unscented Kalman Filter methods. Mud is intended to providing sealing effect with the formation and increase the resistance to outflow or mud loss, which is non-linear. The LPM does not resolve effects along the length of the annular region. It therefore is insensitive to where in the open hole an influx may occur, and assumes that it occurs at the bottom hole region.

Turning now to FIG. 5 and FIG. 6, as mentioned above, this particular embodiment includes an update/correction feature. FIG. 5-FIG. 6 convey how combining multiple models/predictions of the same quantity gives significantly reduced uncertainty in the estimated value. More particularly, this embodiment employs a technique by which even noisy or poor estimates and measurement can be combined arrive at predictions that are less noisy and better than either of the those that were combined. In this context, "noise" is "uncertainty" in either the estimates or the measurements as discussed above.

FIG. 5 includes three curves 500, 503, 506, each representing an uncertainty distribution. The distributions are Gaussian but for illustrative purposes only as any kind of distribution that is suitable to the data may be used. The curve 500 represents the uncertainty distribution for a first measurement and the curve 503 represents the uncertainty distribution for a first estimate. The curve 506 represents the combined measurement and estimation uncertainty distribution. Notice how reduced the uncertainty in the combination is despite relatively large uncertainties in both the measurement curve 500 and the estimate curve 503. FIG. 6 illustrates how the principle can be extended through a second iteration. Thus, embodiments employing this technique for updating estimates can combine a first estimate with a first uncertainty and a measurement with a second uncertainty to obtain a second estimate with a third uncertainty, the third uncertainty being less than the first uncertainty and the second uncertainty.

The presently disclosed technique does not just trigger on a pattern in the data but provides a quantifiable estimate of a kick with quantifiable uncertainty. Since it is based on physics prediction as compared to empirical models and methods, it should be more adaptable to new configurations and changing environments. It combines multiple measurements of drilling operations by linking the measurements with the physics of the operation. This provides for natural scaling of the measurements relative to each to other for making predictions of output variables. It also provides for natural filtering or smoothing of the estimate, sometimes called "physical filtering", instead of ad hoc smoothing or averaging of the measured data as found in conventional practice. Note that not all these characteristics will necessarily be found in all embodiments and, where found together, may not all be manifested to the same extent.

Figure 9:
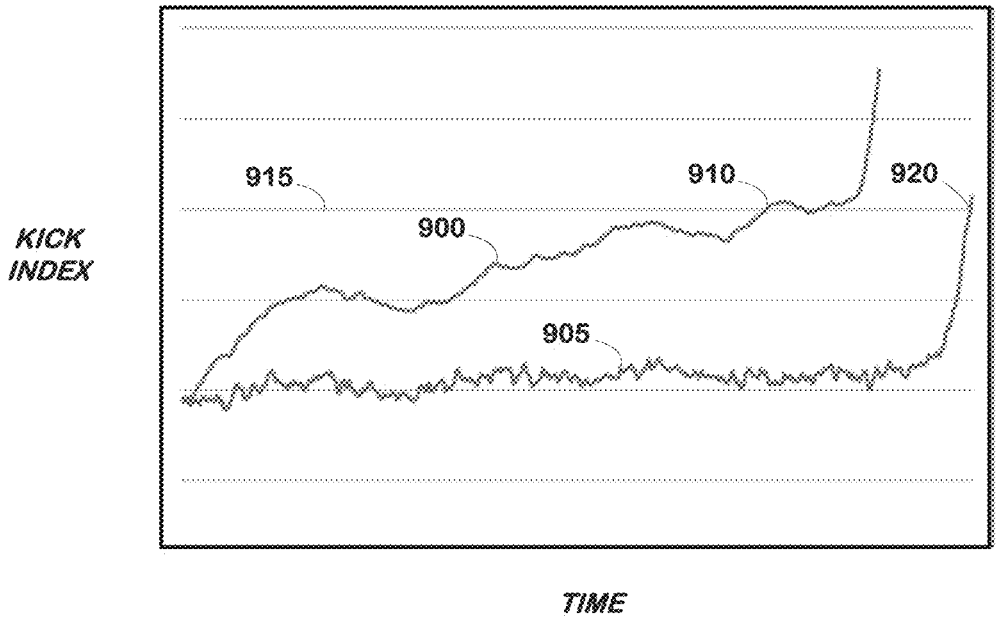
FIG. 9 illustrates the efficacy of the presently disclosed technique.

The efficacy of the presently disclosed technique is illustrated in FIG. 9. The trace 900 represents the performance of the presently disclosed technique. The trace 905 represents the performance of a conventional measured mudpit technique. Note that the kick is detected at time 910 for the disclosed technique (i.e., when the trace 900 crosses the alarm threshold 915) sooner than does the conventional technique, which detects the kick at time 920 (i.e., when the trace 905 crosses the alarm threshold 915). This earlier detection of the kick will typically be advantageous in responding to its occurrence.

In the embodiments set forth above, the sensors 136, 137 and the computing apparatus 145 (including well monitoring software component 321 and data 318) comprise a well monitoring system. The technique can also be integrated into well management and monitoring techniques such as are known to the art, primarily by retrofitting the software architecture with the functionality of the well monitoring software component 321 described above. The embodiments disclosed above are presented in isolation from other wells and/or operations that might be happening nearby.

For example, wells are typically drilled in a field containing other wells. Well management and monitoring techniques are sometimes implemented across multiple wells, for example a number of wells within a field. Thus, well monitoring and management techniques such as those disclosed in U.S. application Ser. No. 14/196,307, U.S. application Ser. No. 13/312,646, and U.S. Pat. No. 8,121,971, may be modified to implement the techniques disclosed herein. The manner in which such techniques known to the art may be modified to implement this technique will be readily apparent to those skilled in the art having the benefit of this disclosure.

TABLE 3

Summation of Values Employed Above

| Variable | Definition of Variable | Units of Measure |
|---|---|---|
| $\alpha$ | Volume fraction of free gas | [·] |
| $\delta_g$ | Specific gravity of free gas | [·] |
| $\gamma_w$ | Mass fraction of water in mud | [·] |
| $\Gamma$ | Annular fluid momentum | [lb/ft/s] |
| $\mu$ | Fluid viscosity | [cp] |
| $\mu_p$ | Fluid plastic viscosity | [cp] |
| $\phi$ | Mass fraction of dissolved gas in mud | [·] |
| $\rho$ | Fluid density | [lb/gal] |
| $\rho_m$ | Density of mud | [lbm/ft$^3$] |
| $\rho_g$ | Density of gas | [lbm/ft$^3$] |
| $\rho_o$ | Density of oil | [lbm/ft$^3$] |
| $\rho_w$ | Density of water | [lbm/ft$^3$] |
| $\rho_{m_{sc}}$ | Density mud at standard conditions | [lbm/ft$^3$] |
| $\sigma_{yp}$ | Yield point | [lbf/100 ft$^2$] |
| $\theta$ | Wellbore angle (from vertical) | (—) |
| $\tau_{yp}$ | Mud yield point | [lbf/100 ft$^2$] |
| $a_1$-$a_8$ | Model constant coefficients | [.] |
| A | Local hydraulic diameter | [ft] |
| $A_s$ | Area of drill section | [ft$^2$] |
| $B_o$ | Formation volume factor | [·] |
| $B_{ob}$ | Formation volume factor at bubble point pressure | [·] |
| $c_l$ | Mud compressibility constant | [psi$^{-1}$] |
| $C_q$ | Reservoir constant | [lbm/fts/psi] |
| $d_1$ | Casing inner diameter | [in] |
| $d_2$ | Drillpipe outer diameter | [in] |
| $d_e$ | Casing outer diameter | [ft] |
| $d_i$ | Drillpipe inner diameter | [ft] |
| $d_h$ | Hydraulic diameter | [ft] |
| D | True vertical depth | [ft] |
| $d_b$ | Bit diameter | [in] |
| $D_h$ | Hole depth | [ft] |
| $D_{h0}$ | Initial hole depth | [ft] |
| E | Volume mudulus | [psi][·] |
| f | Friction factor | [·] |
| $F_f$ | Frictional force term | |
| $f_1$-$f_8$ | Model fractional functions | [ft/s] |
| $F_j$ | Jet impact force | [lbf] |
| g | Gravitational constant | [ft/s$^2$] |
| $g_p$ | Pore pressure gradient | [lbm/gal] |
| h | Fractional bit tooth wear | [.] |
| I | Fluid inertia | [lb/ft$^4$] |
| $I_{ann}$ | Drill section fluid inertia | [lb/ft$^4$] |
| k | Consistency index | [·] |
| $L_s$ | Length of drill section | [ft] |
| $\dot{m}_g$ | Rate of free gas dissolution | [lbm/sec] |
| n | Flow behavior index | [·] |
| N | Rotary speed | [rpm] |
| $P_0$ | Nominal pressure variation factor | [psi] |
| P | Pressure | [lb/ft$^2$] |
| $P_{bh}$ | Bottomhole pressure loss | [psi] |
| $P_d$s | Drillstring pressure loss | [psi] |
| $P_f$ | Formation pressure | [psi] |
| $P_h$ | Hydrostatic pressure | [psi] |
| $P_p$ | Pump pressure | [psi] |
| $P_R$ | Reservoir pressure | [psi] |
| P,a | Annulus pressure loss | [psi] |
| P(y) | Reservoir pressure at reservoir depth, y | [psi] |
| $P_{sc}$ | Pressure of mud at standard conditions | [psi] |
| q | Gas influx rate | [lbm/ft − s] |
| $Q_o$ | Mud outflow rate | [gpm] |
| $Q_p$ | Mud inflow rate | [gpm] |
| $R_a$ | Annulus pressure loss coefficient | [lb − s$^2$/m$^8$] |
| $R_d$s | Drillstring pressure loss coefficient | [lb − s$^2$/m$^8$] |
| Re | Reynolds number | [·] |

TABLE 3-continued

Summation of Values Employed Above

| Variable | Definition of Variable | Units of Measure |
|---|---|---|
| $Re_L$ | Laminar Reynolds number | [·] |
| $Re_T$ | Turbulent Reynolds number | [·] |
| $R_f$ | Formation pressure loss coefficient | [lb − s/m$^5$] |
| $R_0$ | Nominal rate of penetration | [ft/s] |
| ROP | Rate of penetration | [ft/s] |
| $R_s$ | Gas-oil ratio | [·] |
| t | Time | [s] |
| T | Temperature | [° R] |
| $T_{sc}$ | Temperature of mud at standard conditions | [° R] |
| $u_o$ | Oil flow velocity in the x-direction | [ft/s] |
| $u_m$ | Mud flow velocity in the x-direction | [ft/s] |
| $u_g$ | Gas flow velocity in the x-direction | [ft/s] |
| v | Fluid velocity | [ft/s] |
| $V_{mp}$ | Mud pit volume | [bbls] |
| W | Weight on bit | [1000 lbf] |
| $\left(\frac{W}{d_b}\right)_t$ | Threshold bit weight/inch of bit diameter | [1000 lbf/in] |
| x | Spatial coordinate | [ft] |
| z | Gas compressibility factor | [·] |

The following patents referenced above are identified more completely:

U.S. application Ser. No. 14/196,307, entitled, "System and Console for Monitoring and Managing Well Site Operations," filed Mar. 4, 2014, in the name of the inventors Fereidoun Abbassian et al., and published Sep. 4, 2014, as U.S. Patent Publication 2014/0246238.

U.S. application Ser. No. 13/312,646, entitled, "Geological Monitoring Console," filed Dec. 6, 2011, in the name of the inventor Paul J. Johnston and published Jun. 6, 2013, as U.S. Patent Publication 2013/0144531.

U.S. Letters Pat. No. 8,121,971, entitled, "Intelligent Drilling Advisor", and issued Feb. 21, 2012, to BP Corporation North America Inc., as assignee of the inventors Michael L. Edwards et al.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A well monitoring system, comprising:

a well;

a well system, the well system including at least one sensor measuring at least one well condition; and a computing apparatus, including:

a processor;

a storage;

a bus system over which the processor communicates with the storage;

a data structure residing in the storage in which a set of real-time data acquired by the at least one sensor is stored;

a well monitoring software component residing on the storage that, when executed by the processor over the bus system, performs a method to detect a kick in a well, the method comprising:

storing the set of real-time data from a plurality of measurements of the at least one well condition by the at least one sensor into the data structure in the storage, the at least one well condition being correlative to an unplanned fluid influx into the well;

modeling an operation of the well with a physics-based, state space model of the well system to obtain an estimate of the at least one well condition;

accessing the set of real-time data from the storage; and applying the set of real-time data accessed from the storage and the estimate of the well condition to a probabilistic estimator to yield a probability of an occurrence of a kick and a confidence measure for the probability.

2. The well monitoring system of claim 1, wherein the at least one well condition is a downhole condition.

3. The well monitoring system of claim 1, wherein the at least one well condition is a condition present in drilling ahead, tripping, or breathing.

4. The well monitoring system of claim 1, further comprising:

assessing whether a corrective action is desired; and implementing the corrective action;

wherein the assessing and the implementing are performed by the computing apparatus.

5. The well monitoring system of claim 1, wherein the computing apparatus is distributed across a plurality of computers.

6. The well monitoring system of claim 1, wherein the at least one well condition comprises mud pit volume, return flow, input flow, standpipe pressure, drilled depth, hook load, or gas content.

7. The well monitoring system of claim 1, wherein modeling the operation of the well includes modeling the operation of the well using a distributed hydraulics model or a lumped parameter model.

8. The well monitoring system of claim 1, wherein the method further comprises updating the estimate using the measurement.

9. A computer-implemented method to detect a kick in a well, the method comprising:

storing a set of real-time data from a plurality of measurements of a well condition acquired by at least one sensor during an operation of the well, the well condition being correlative to an unplanned fluid influx into the well;

modeling the operation of the well with a physics-based, state space model of a well system for the well to obtain an estimate of the well condition, the model being cyber-physically coupled to the well system;

accessing the set of real-time data that was stored; and applying the real-time data set and the estimate of the well condition to a probabilistic estimator to yield a probability of an occurrence of a kick and a confidence measure for the probability of the occurrence of the kick;

wherein the storing, accessing, modeling, and applying are performed by a computing apparatus.

10. The computer-implemented method of claim 9, wherein storing the set of real-time data includes buffering the real-time data.

11. The computer-implemented method of claim 9, further comprising communicating the probability of the occurrence of the kick and the confidence measure.

12. The computer-implemented method of claim 9, further comprising:

assessing whether a corrective action is desired; and implementing the corrective action.

13. The computer-implemented method of claim 9, wherein the computing apparatus is distributed across a plurality of computers.

14. The computer-implemented method of claim 9, wherein modeling the operation of the well includes modeling the operation of the well using a distributed hydraulics model or a lumped parameter model.

15. The computer-implemented method of claim 9, wherein modeling the operation of the well includes calling one or models from the well monitoring software component.

16. A non-transitory program storage medium, encoded with instructions that, when executed by a processor, perform a method to detect a kick in a well, the method comprising:

storing a set of real-time data from a plurality of measurements of a well condition acquired by at least one sensor during an operation of the well, the well condition being correlative to an unplanned fluid influx into the well;

modeling the operation of the well with a physics-based, state space model of a well system for the well to obtain an estimate of the well condition, the model being cyber-physically coupled to the well system;

accessing the real time data set that was stored; and applying the accessed real-time data set and the estimate of the well condition to a probabilistic estimator to yield a probability of an occurrence of a kick and a confidence measure for the probability of the occurrence of the kick.

17. The non-transitory program storage medium of claim 16, wherein the method further comprises:

assessing whether a corrective action is desired; and implementing the corrective action.

18. The non-transitory program storage medium of claim 16, wherein modeling the operation of the well includes modeling the operation of the well using a distributed hydraulics model or a lumped parameter model.

19. The computer-implemented method of claim 16, further comprising updating the estimate using the measurement.

20. A computing apparatus programmed to perform a method. to detect a kick in a well, the method comprising:

a processor;

a bus system;

a storage with which the processor communicates over the bus system;

a well monitoring software component residing on the storage that, when executed. by the processor, performs the method, the method comprising:

storing a set of real-time data from a plurality of measurements of a well condition acquired by at least one sensor during an operation of the well, the well condition being correlative to an unplanned fluid influx into the well;

modeling the operation of the well with a physics-based, state space model. of a well system for the well to obtain an estimate of the well condition, the model being cyber-physically coupled to the well system;

accessing the stored real-time data set; and applying the accessed real-time data set and the estimate of the well condition to a probabilistic estimator to yield a probability of an occurrence of a kick and a confidence measure for the probability of the occurrence of the kick.

21. The computing apparatus of claim 20, wherein the method further comprises:

assessing whether a corrective action is desired; and implementing the corrective action.

22. The computing apparatus of claim 20, wherein the computing apparatus is distributed across a plurality of computers.

23. The computing apparatus of claim 20, wherein modeling the operation of the well includes modeling the operation of the well using a distributed hydraulics model or a lumped parameter model.

24. The computing apparatus of claim 20, the method further comprises updating the estimate using the measurement.

* * * * *